US005980211A

United States Patent [19]

Tojo et al.

[11] Patent Number: 5,980,211

[45] Date of Patent: Nov. 9, 1999

[54] CIRCUIT ARRANGEMENT FOR DRIVING A RECIPROCATING PISTON IN A CYLINDER OF A LINEAR COMPRESSOR FOR GENERATING COMPRESSED GAS WITH A LINEAR MOTOR

[75] Inventors: Naoto Tojo, Nara; Shinichi Matsumura, Osaka; Takafumi Nakayama, Hyogo; Daizo Takaoka, Osaka, all of Japan

[73] Assignee: Sanyo Electric Co., Ltd., Moriguchi, Japan

[21] Appl. No.: 08/840,463

[22] Filed: Apr. 18, 1997

[30] Foreign Application Priority Data

| | | | |
|---|---|---|---|
| Apr. 22, 1996 | [JP] | Japan | 8-100047 |
| Apr. 30, 1996 | [JP] | Japan | 8-108908 |
| Jul. 9, 1996 | [JP] | Japan | 8-179493 |
| Oct. 9, 1996 | [JP] | Japan | 8-268446 |
| Oct. 18, 1996 | [JP] | Japan | 8-275940 |
| Oct. 18, 1996 | [JP] | Japan | 8-275941 |

[51] Int. Cl.[6] ..... F04B 49/00

[52] U.S. Cl. ..... 417/45

[58] Field of Search ..... 62/228, 6; 330/29, 330/284; 417/416, 417, 418, 45, 22, 42, 44.1, 44.11; 318/121; 333/14; 381/106

[56] References Cited

U.S. PATENT DOCUMENTS

| | | | |
|---|---|---|---|
| 3,937,600 | 2/1976 | White | 417/416 |
| 3,947,155 | 3/1976 | Bidol | 417/417 |
| 3,980,964 | 9/1976 | Grodinsky | 330/29 |
| 4,067,667 | 1/1978 | White . | |
| 4,291,258 | 9/1981 | Clark et al. | 318/124 |
| 4,353,220 | 10/1982 | Curwen et al. | 62/228 |
| 4,490,691 | 12/1984 | Dolby | 333/14 |
| 4,498,055 | 2/1985 | Dolby | 330/284 |
| 4,498,060 | 2/1985 | Dolby | 333/14 |
| 4,736,433 | 4/1988 | Dolby | 381/106 |
| 4,750,871 | 6/1988 | Curwen | 417/418 |
| 5,535,593 | 7/1996 | Wu et al. | 62/6 |

FOREIGN PATENT DOCUMENTS

| | | |
|---|---|---|
| 52-84507 | 7/1977 | Japan . |
| 2-154950 | 6/1990 | Japan . |

*Primary Examiner*—Charles G. Freay
*Assistant Examiner*—Robert Z. Evora
*Attorney, Agent, or Firm*—Armstrong, Westerman, Hattori, McLeland & Naughton

[57] ABSTRACT

In a linear compressor driving apparatus, a position instructing portion (31) outputs a position instruction value Pref of a piston in accordance with an equation A*sin ωt. A position control portion (33) calculates a speed instruction value Vref by multiplying difference between position instruction value Pref and position present value Pnow by a constant Gv. A speed control portion (35) calculates a current instruction value Iref by multiplying a difference between speed instruction value Vref and speed present value Vnow by a constant Gi. A current control portion (37) controls a power source (3) so that current present value Inow becomes equal to the current instruction value Iref. Phase control portion (38) adjusts ω and Gi so as to eliminate phase difference between speed present value Vnow and current instruction value Iref. Since thrust of linear motor can be directly and appropriately controlled in accordance with the load condition, high efficiency is obtained.

22 Claims, 33 Drawing Sheets

CIRCUIT ARRANGEMENT FOR DRIVING A RECIPROCATING PISTON IN A CYLINDER OF A LINEAR COMPRESSOR FOR GENERATING COMPRESSED GAS WITH A LINEAR MOTOR

BACKGROUND OF THE INVENTION

1. Field of the Invention

The present invention relates to a driving apparatus for a linear compressor. More specifically, it relates to an apparatus for driving a linear compressor in which a piston is reciprocally moved in a cylinder by a linear motor for generating compressed gas.

2. Description of the Background Art

Recently, a linear compressor as a mechanism for compressing expanded refrigerant gas in a cooling apparatus such as a refrigerator has been developed. In the linear compressor, a piston is driven by a linear motor and a resonance mechanical spring, and the gas is compressed.

In such a linear compressor, non-linear force (spring force of gas) is generated in a compression phase in association with suction, compression and discharge of gas, and the non-linear force varies because of load variation at the time of activation, for example.

However, in a conventional linear compressor, there is not at all means for controlling thrust of the linear motor, and a constant electric power is supplied to the linear motor regardless of the load variation. Therefore, ratio of an output energy with respect to an input energy (hereinafter referred to as efficiency) has been low. Though a method of controlling voltage to be applied to a coil of the linear motor in accordance with the load variation has been studied, it is not satisfactory.

SUMMARY OF THE INVENTION

Therefore, an object of the present invention is to provide driving apparatus for a linear compressor enabling high efficiency.

In the driving apparatus for a linear compressor in accordance with one aspect of the present invention, a multiloop control configuration including position instructing/detecting portion, speed instructing/detecting portion, current instructing/detecting portion and current control portion is employed, and frequency of the position instruction value is adjusted such that phase difference between speed present value and current instruction value is eliminated. Therefore, thrust of the linear motor can be directly and appropriately controlled in accordance with the load condition, enabling higher efficiency.

Preferably, the speed detecting portion detects speed of the piston by differentiating the result of detection by the position detecting portion. Therefore, it is not necessary to provide a sensor for speed detection separately.

Preferably, the speed instructing portion calculates a speed instruction value by multiplying difference between the position instruction value and the position present value by a first gain constant, the current instructing portion calculates the current instruction value by multiplying the difference between the current instruction value and the current present value by a second gain constant, and the gain adjusting portion adjusts at least one of the first and second gain constants so that phase difference between the speed present value and the current instruction value is eliminated. Accordingly, response of current control can be adjusted in accordance with load condition, and thrust of the linear motor can more appropriately be controlled.

Preferably, the speed instructing portion calculates speed instruction value by multiplying difference between position instruction value and position present value by a first gain constant, the current instructing means calculates the current instruction value by multiplying difference between current instruction value and current present value by a second gain constant, and the gain adjusting portion adjusts at least one of the first and second gain constants so that difference between a peak value of the position instruction value and a peak value of the position detection value is eliminated. Accordingly, thrust of the linear motor can be directly and appropriately controlled in accordance with load condition, enabling higher efficiency.

More preferably, the phase difference detecting portion detects a zero cross point of the speed present value and the zero cross point of the current instruction value, and detects phase difference based on the result of detection. Therefore, the phase difference detecting portion can be formed in a simple manner.

More preferably, the phase difference detecting portion detects a peak point of the speed present value and a peak point of the current instruction value, and detects phase difference based on the result of detection. Therefore, the phase difference detecting portion can be formed in a simple manner.

Preferably, an amplitude adjusting portion adjusts amplitude of a sine function used in the position instructing portion in accordance with the necessary amount of compressed gas. Therefore, the thrust of the linear motor can be directly and appropriately controlled in accordance with the necessary amount of compressed gas, enabling higher efficiency.

More preferably, the compressed gas is used for cooling an object, and the amount of necessary compressed gas is represented by a deviation between the temperature of the object and a predetermined target temperature. Therefore, the object can be cooled precisely to the target temperature.

More preferably, an activating portion adjusts at least one of amplitude and frequency of the sine function used in the position instructing portion so that amplitude of the piston is gradually increased to the target value at the time of activation. Therefore, vibration of the piston at the time of activation can be stabilized, and collision of the piston head against the cylinder can be prevented.

More preferably, a stopping portion adjusts at least one of amplitude and frequency of the sine function used in the position instructing portion so that amplitude of the piston is gradually reduced at the time of stopping. Therefore, vibration of the piston at the time of stopping can also be stabilized.

In the driving apparatus for a linear compressor in accordance with another aspect of the present invention, the position instructing portion instructs position of the piston in accordance with a sine function, the current instructing portion generates a current instruction value such that the position detection value matches the position instruction value, and a power supply outputs a driving current in accordance with the current instruction value. When phase difference between the current instruction value and the speed of the piston exceeds a tolerance, a frequency control portion reduces at least one of the current instruction value and the sine function to a predetermined ratio, and controls frequency of the sine function so that phase difference is eliminated. Accordingly, when the frequency is controlled, amplitude of the piston is once reduced. Accordingly, even when efficiency is improved by frequency control, piston amplitude is not increased, and therefore collision of the piston head against an inner wall end of the cylinder can be prevented.

According to a driving apparatus for a linear compressor in accordance with a still further aspect of the present invention, the current instructing portion generates a current instruction value in accordance with a sine function, and amplitude control portion controls amplitude of the sine function so that an amplitude detection value of the piston matches a target value, and the power source outputs a driving current in accordance with the current instruction value to the linear motor. The frequency control portion reduces the amplitude of the sine function to a predetermined ratio when phase difference between current instruction value and the piston speed exceeds a tolerance, and controls frequency of the sine function so that the phase difference is eliminated. Therefore, collision of the piston head against the inner wall end of the cylinder can be prevented, and in addition, the structure can be simplified.

In the driving apparatus for a linear compressor in accordance with a still further aspect of the present invention, the position instruction portion instructs position of the piston in accordance with a sine function, the current instruction portion generates a current instruction value so that a position detection value matches a position instruction value, and the power source outputs a driving current in accordance with the current instruction value to the linear motor. The amplitude control portion controls at least one of the amplitude of the sine function and the current instruction value so that larger one of amplitudes to the sides of upper and lower dead points matches a target value. Therefore, even when a neutral point of the piston is offset from an origin, the piston head never collides against the inner wall end of the cylinder.

In the driving apparatus for a linear compressor in accordance with a still further aspect of the present invention, the current instructing portion generates a current instruction value in accordance with a sine function, the amplitude control portion controls amplitude of the sine function so that the amplitude detection value of the piston matches a target value, and the power source outputs a driving current in accordance with the current instruction value to the linear motor. The amplitude control portion controls amplitude of the sine function so that larger one of the upper and lower dead point amplitudes matches a target value. Therefore, collision of the piston head against the inner wall end of the cylinder can be prevented, and in addition, structure can be simplified.

According to a driving apparatus for a linear compressor in accordance with a still further aspect of the present invention, the position instruction portion instructs a position of the piston in accordance with a sine function, current instruction portion generates a current instruction value so that the position detected value matches the position instruction value, and the power source outputs a driving current in accordance with the current instruction value to the linear motor. A shift amount control portion controls an amount of shift of the sine function so that an amount of shift of the neutral point of the piston from the origin is eliminated. Therefore, the shift amount of the neutral point of the piston from the origin can be eliminated, and collision of the piston head against the inner wall end of the cylinder can be prevented. Even when the linear motor includes two pistons, head clearance of both of these two pistons can be controlled similarly with high precision. Preferably, an amplitude detecting portion for detecting amplitude to the side of the upper lead point and amplitude to the side of the lower dead point, and an amplitude control portion for controlling at least one of the amplitude of the sine function and the current instruction value such that larger one of the amplitudes to the upper and lower dead points matches a target value are further provided. Therefore, collision of the piston head against the inner wall end of the cylinder can surely be prevented.

In the driving apparatus for a linear compressor in accordance with a still further aspect of the present invention, the current instructing portion generates a current instruction value in accordance with a sine function, the amplitude control portion controls amplitude of the sine function so that amplitude detection value of the piston matches a target value, and the power source outputs a driving current in accordance with the current instruction value to the linear motor. The shift amount control portion controls the amount of shift of the sine function so that an amount of shift of the neutral point of the piston from the origin is eliminated. Therefore, the shift amount of the neutral point of the piston from the origin can be eliminated, and collision of the piston head against the inner wall end of the cylinder can be prevented. Even when the linear motor has two pistons, head clearance of both of these two pistons can be similarly controlled with high precision. Further, structure can be simplified.

Preferably, the amplitude detecting portion detects the amplitude to the side of the upper dead point and amplitude to the side of the lower dead point, and the amplitude control portion controls amplitude of the sine function so that larger one of the amplitudes to the sides of the upper and lower dead points matches a target value. Therefore, collision of the piston head against the inner wall end of the cylinder can surely be prevented.

In the driving apparatus for a linear compressor in accordance with a still further aspect of the present invention, open period of a discharge valve is detected and driving current is cut off for a prescribed period based on the result of detection. Accordingly, ineffective current of which phase is different from the piston speed can be eliminated, and efficiency higher than the prior art can be obtained.

Preferably, a current control type power source is used and the output current thereof is directly controlled. Therefore, highly precise control is possible.

Preferably, a voltage controlled type power source is used and the current flowing from the power source to the linear compressor is controlled by a switch. Therefore, current is controlled by a simple structure.

Preferably, the driving current is cut off while the discharge valve is opened. Therefore, high efficiency is obtained by a simple control.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

[First Embodiment]

Figure 1:
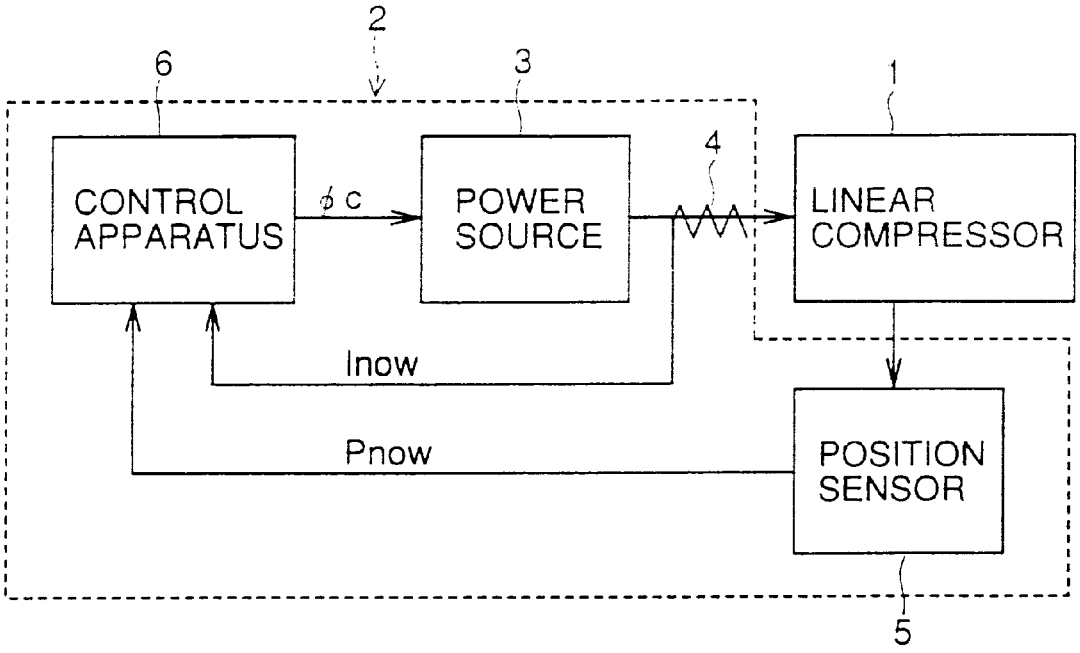
FIG. 1 is a block diagram showing a structure of a linear compressor control apparatus in accordance with a first embodiment of the present invention.

FIG. 1 is a block diagram showing a structure of a driving apparatus 2 for a linear compressor 1 in accordance with the first embodiment of the present invention.

Referring to FIG. 1, the driving apparatus 2 includes a power source 3, a current sensor 4, a position sensor 5 and a control apparatus 6. Power source 3 supplies driving current I to a linear motor of linear compressor 1. Current sensor 4 detects present value Inow of an output current from power source 3. Position sensor 5 directly or indirectly detects present value Pnow of the position of a piston of linear compressor 1. Control apparatus 6 outputs a control signal Φc to power source 3 and controls output current I from power source 3, based on the current present value Inow detected by current sensor 4 and on the position present value Pnow detected by position sensor 5.

Figure 2:
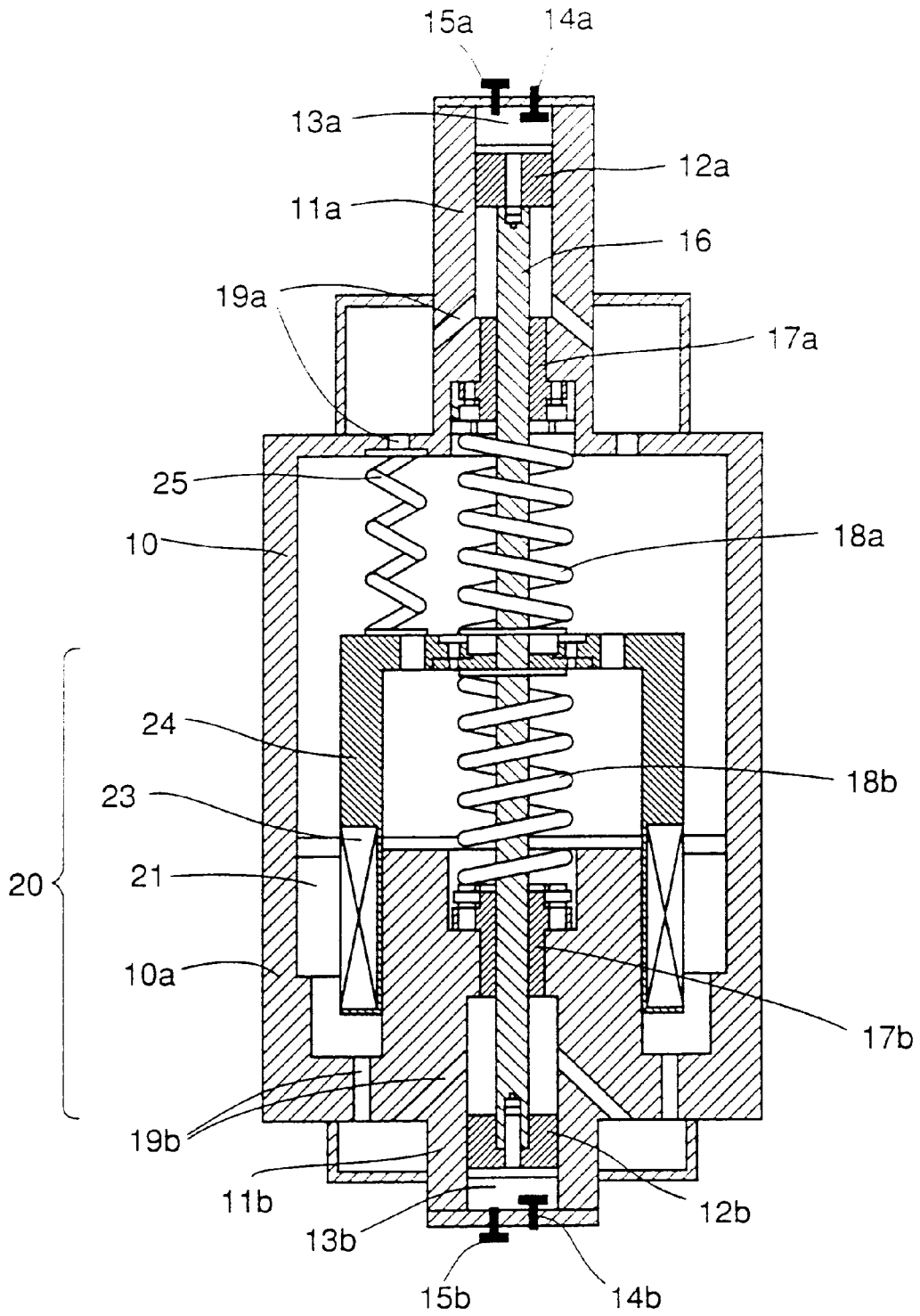
FIG. 2 is a cross section showing a structure of the linear compressor shown in FIG. 1.

FIG. 2 is a cross section showing the structure of linear compressor 1. Referring to FIG. 2, linear compressor 1 includes two cylinders 11*a* and 11*b* provided respectively on upper and lower ends of a cylindrical casing 10, two pistons 12*a* and 12*b* fitted in cylinders 11*a* and 11*b*, respectively, two compression spaces 13*a* and 13*b* formed facing heads of pistons 12*a* and 12*b*, respectively, and two sets of suction valves 14*a*, 14*b* and discharge valves 15*a*, 15*b* which are opened/closed in accordance with gas pressure in compression spaces 13*a* and 13*b*, respectively.

Two pistons 12*a* and 12*b* are provided at the other end portions of one shaft 16, respectively. The shaft 16 is supported reciprocably in cylinders 11*a* and 11*b* as well as casing 10, by two sets of linear ball bearings 17*a*, 17*b* and coil springs 18*a*, 18*b*. In spaces formed by rear sides of heads of pistons 12*a*, 12*b* and cylinders 11*a*, 11*b*, gas leakage holes 19*a* and 19*b* are provided for preventing irreversible compression.

Further, the linear compressor 1 includes a linear motor 20 for reciprocating the shaft 16 and the pistons 12*a* and 12*b*. The linear motor 20 is a highly controllable voice coil motor provided with a stator portion including a fixed portion including a yoke portion 10*a* and a permanent magnet 21 and a movable portion including a coil 23 and a cylindrical support member 24. The yoke portion 10*a* forms a part of the casing 10. The permanent magnet 21 is provided on an inner peripheral wall of the yoke portion 10*a*. The support member 24 has one end reciprocably inserted between the permanent magnet 21 and an outer peripheral wall of the cylinder 11*b* and the other end fixed at a central portion of the shaft 16. The coil 23 is provided opposing to the permanent magnet 21 at one end of the support member. The power source 3 and coil 23 are connected by a coil spring shaped electric wire 25.

The linear compressor 1 has a resonance frequency which is determined in accordance with weights of pistons 12*a*, 12*b*, shaft 16, coil 23 and support member 24, spring constant of the gas in compression spaces 13*a* and 13*b*, spring constants of coil spring 18*a* and 18*b* and so on. When the linear motor 20 is driven at the resonance frequency, compressed gas can be generated with high efficiency in upper and lower two compression spaces 13*a* and 13*b*.

Figure 3:
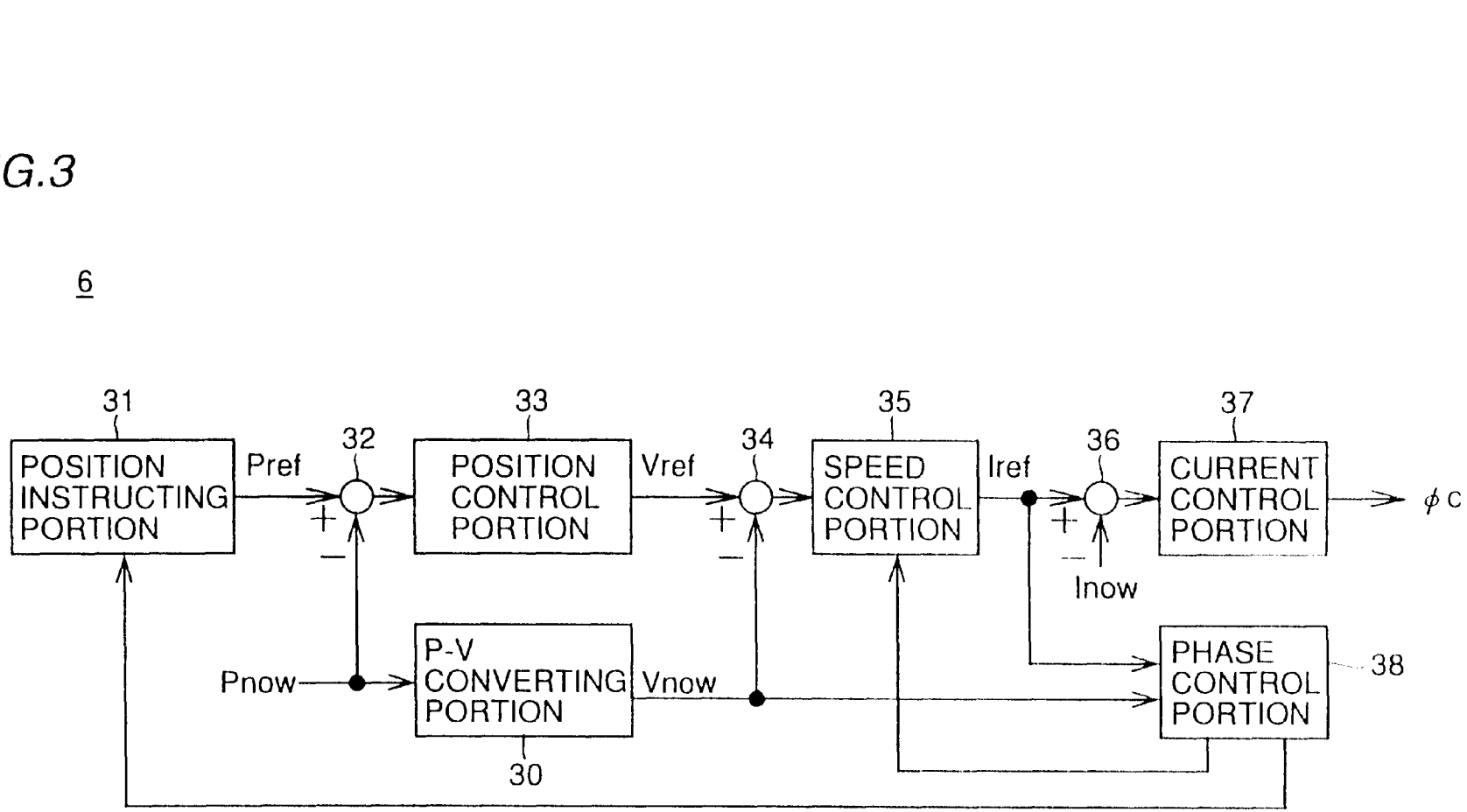
FIG. 3 is a block diagram showing the structure of the control apparatus shown in FIG. 1.

FIG. 3 is a block diagram showing the structure of control apparatus 6 shown in FIG. 1. Referring to FIG. 3, control the apparatus 6 includes a P-V converting the portion 30, position instructing portion 31, three subtracters 32, 34 and 36, a position control portion 33, a speed control portion 35, a current control portion 37 and a phase control portion 38. The P-V converting portion 30 calculates speed present value Vnow by differentiating position present value Pnow detected by the position sensor 5. The position instructing portion 31 applies a position instruction value Pref to the subtracter 32 in accordance with an equation Pref=A*sin ωt (where A represents amplitude and ω represents angular frequency). The subtracter 32 calculates difference Pref−Pnow between the position instruction value Pref applied from the position instructing portion 31 and the position present value Pnow detected by the position sensor 5, and applies the result of calculation Pref−Pnow to the position control portion 33.

The position control portion 33 calculates speed instruction value Vref based on an equation Vref=Gv* (Pref−Pnow) (where Gv represents a gain constant), and applies the result of calculation Vref to the subtracter 34. The subtracter 34 calculates difference Vref−Vnow between the speed instruction value Vref applied from the position control portion 33 and the speed present value Vnow generated at P-V the converting portion 30, and applies the result of calculation Vref−Vnow to the speed control portion 35.

The speed control portion 35 calculates current instruction value Iref based on an equation Iref=Gi* (Vref−Vnow) (where Gi represents a gain constant), and applies the result of calculation Iref to the subtracter 36. The subtracter 36 calculates difference Iref−Inow between current instruction value Iref applied from the speed control portion 35 and current present value Inow detected by current sensor 4, and applies the result of calculation Iref−Inow to the current control portion 37.

The current control portion 37 controls an output current I from the power source 3 by applying a control signal Φc to power the source 3 such that the output Iref−Inow from the subtracter 36 attains to 0. Control of the output current I of power source 3 is performed in accordance with the PWM (pulse width modulation) method or the PAM (pulse-amplitude modulation) method, for example.

The phase control portion 38 detects phase difference between speed present value Vnow generated at the P-V converting portion 30 and current instruction value Iref generated at the speed control portion 35, and adjusts angular frequency ω in the equation Pref=A*sin ωt used in the position instruction portion 31 and gain constant Gi of the equation Iref=Gi*(Vref−Vnow) used in the speed control portion 35, so that the phase difference is eliminated.

Figure 4:
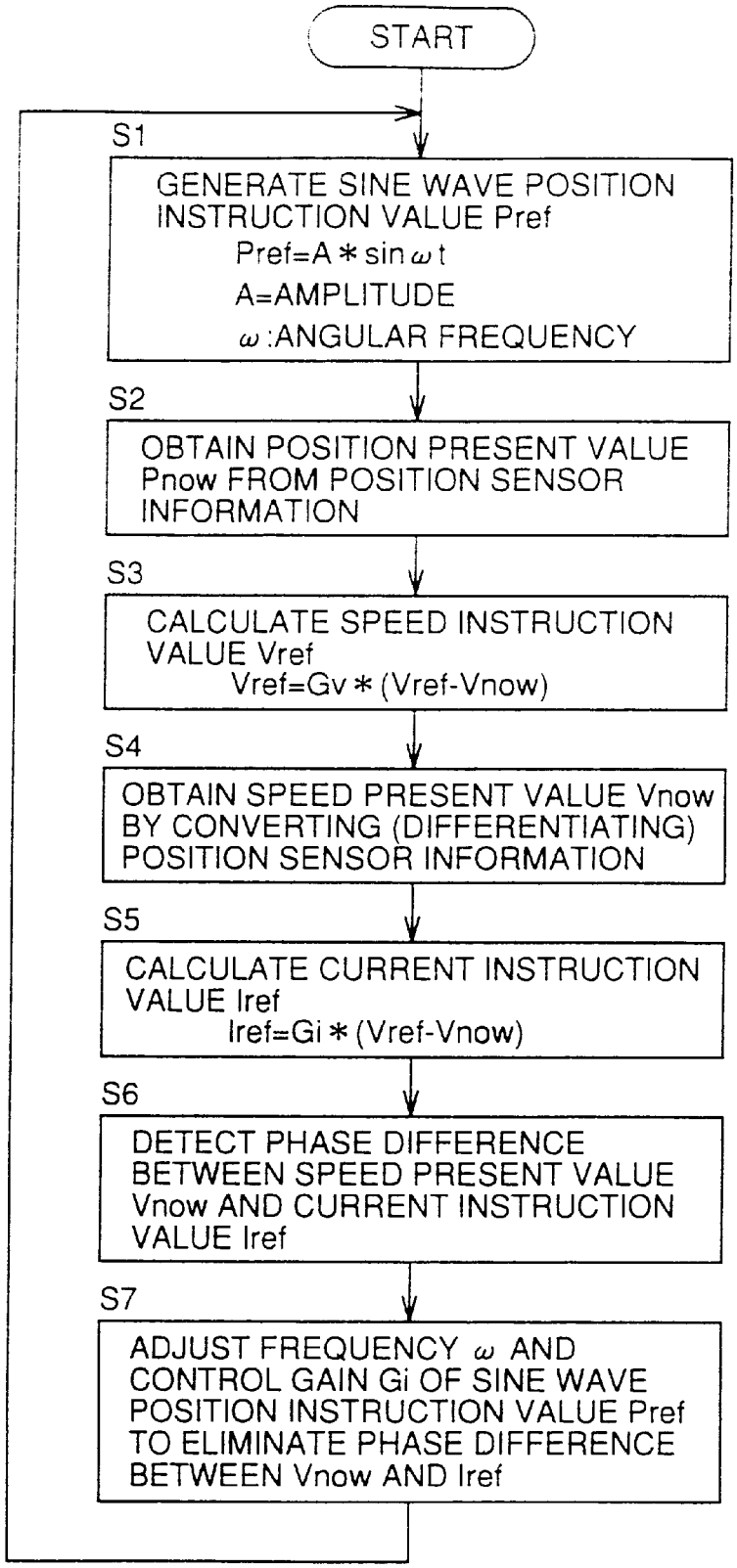
FIG. 4 is a flow chart showing the operation of the control apparatus shown in FIG. 3.

FIG. 4 is a flow chart showing the operation of the control apparatus 6 shown in FIG. 3. Referring to the flow chart, the operation of linear compressor 1 and driving apparatus 2 therefor shown in FIGS. 1 to 3 will be briefly described.

First, in step S1, the position instruction value Pref is generated at the position instructing portion 31, the speed instruction value Vref is generated at the position control portion 33, and the current instruction value Iref is generated at speed control portion 35. When current is supplied to the coil 23 of linear motor 20, a movable portion of the linear motor 20 starts reciprocating motion, thus starting generation of compressed gas.

In step S2, position present value Pnow is detected by position sensor 5, and detected position present value Pnow is applied to subtracter 32 and to P-V converting portion 30. In step S3, speed instruction value Vref=Gv* (Pref-Pnow) is calculated by position control portion 33, and in step S4, position present value Pnow is converted to speed present value Vnow by P-V converting portion 30. Speed present value Vnow is applied to subtracter 34 and position control portion 38.

In step S5, current instruction value Iref=Gi* (Vref−Vnow) is calculated by speed control portion 35, and the calculated value Iref is applied to subtracter 36 and phase control portion 38. Current control portion 37 controls power source 3 such that current present value Inow matches the current instruction value Iref.

In step S6, phase difference between speed present value Vnow and current instruction value Iref is detected by phase control portion 38. In step S7, phase control portion 38 adjusts gain constant Gi and angular frequency of position instruction value Pref so that phase difference between speed present value Vnow and current instruction value Iref is eliminated.

Thereafter, steps S1 to S7 are repeated and state of operation of linear compressor 1 is stabilized rapidly. Even when there is load variation after activation, thrust of linear motor 20, that is, driving current I is directly and appropriately controlled, enabling high efficiency.

Though position present value Pnow is detected by position sensor 4 and speed present value Vnow is calculated by differentiating the detected value in the present embodiment, a speed sensor may be provided in place of position sensor 4 and position present value Pnow may be calculated by integrating the detected value Vnow. Alternatively, position and speed sensors may be provided.

Of gain constants Gv of position control portion 33 and Gi of speed control portion 35, only the gain constant Gi is adjusted by phase control portion 38 in the present embodiment. Alternatively only the gain constant Gv may be adjusted, or both may be adjusted.

[Second Embodiment]

Figure 5:
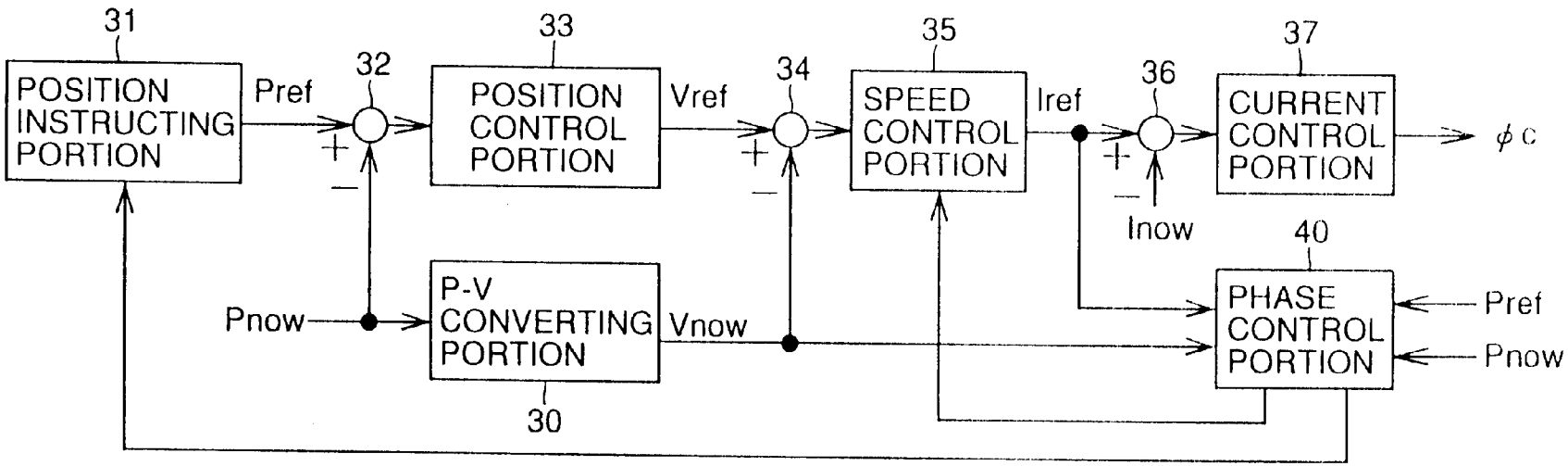
FIG. 5 is a block diagram showing a control apparatus included in the linear compressor driving apparatus in accordance with the second embodiment of the present invention.

FIG. 5 is a block diagram showing a structure of control apparatus 39 included in the driving apparatus for linear compressor 1 in accordance with the second embodiment of the present invention, which corresponds to FIG. 3.

Referring to FIG. 5, the control apparatus 39 differs from control apparatus 6 shown in FIG. 3 in that phase control portion 38 is replaced by a phase control portion 40.

Figure 6:
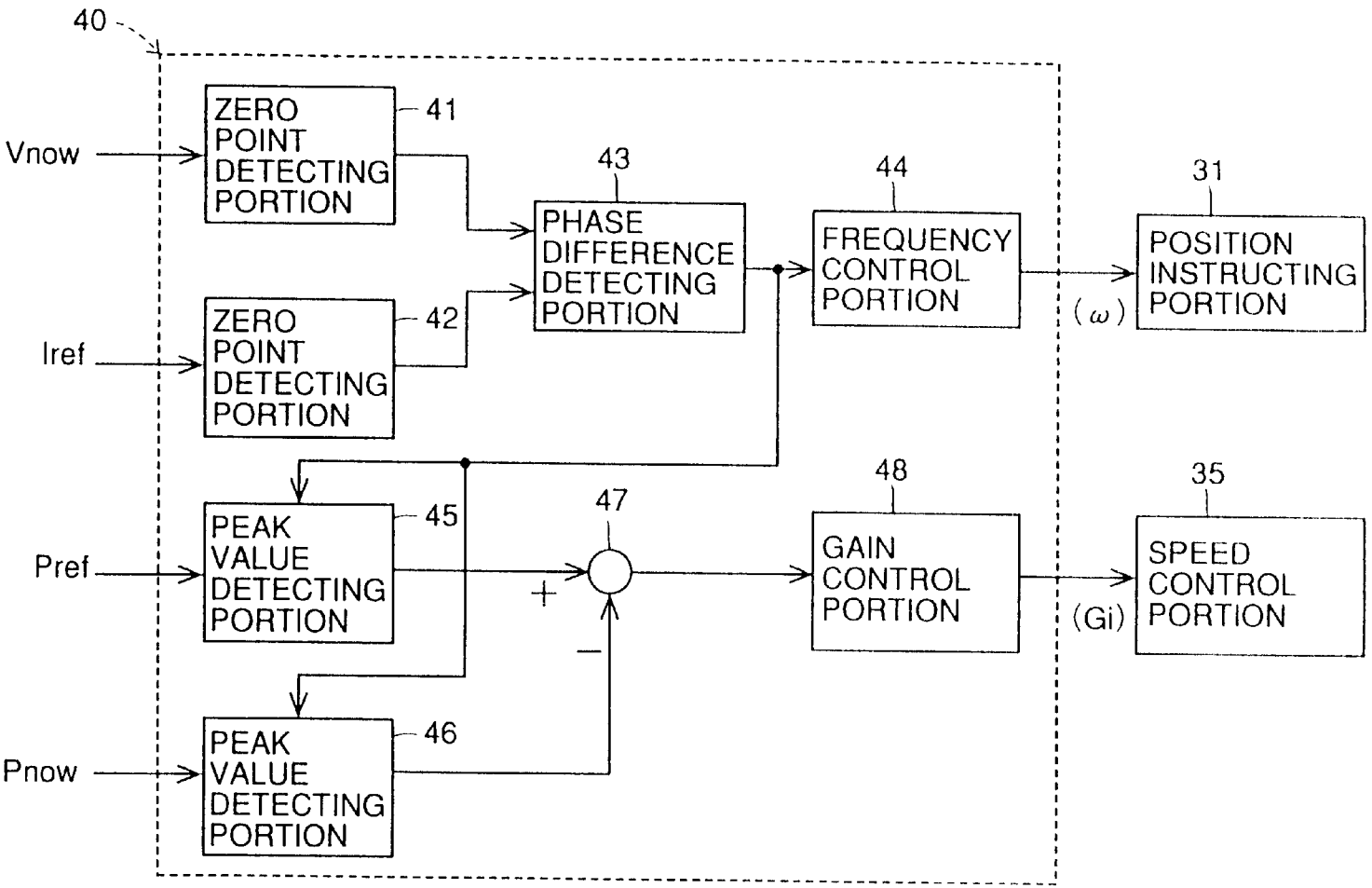
FIG. 6 is a block diagram showing the structure of a phase control portion shown in FIG. 5.

Referring to FIG. 6, phase control portion 40 includes zero point detecting portions 41 and 42, a phase detecting portion 43, a frequency control portion 44, peak value detecting portions 45 and 46, a subtracter 47 and a gain control portion 48.

Zero point detecting portion 41 detects a zero cross point of speed present value Vnow generated at P-V converting portion 30. Zero point detecting portion 42 detects a zero cross point of current instruction value Iref applied from speed control portion 35. Zero point detecting portion 41 samples speed present value Vnow at a period sufficiently smaller than that of speed present value Vnow and detects the fact that a product of last sampling value and the present sampling value is a negative value and that the present sampling value is a positive value, whereby it detects the fact that the speed present value Vnow has passed the zero cross point, for example. Zero point detecting portion 42 operates in the similar manner.

Phase difference detecting portion 43 detects phase difference between speed present value Vnow and current instruction value Iref based on the zero cross point of speed present value Vnow detected at zero point detecting portion 42 and zero cross point of current instruction value Iref detected at zero point detecting portion 42. Frequency control portion 44 adjusts angular frequency ω of the equation Pref=A*sin ωt used in position instructing portion 31 so that phase difference between speed present value Vnow and current instruction value Iref detected at phase difference detecting portion 43 is eliminated.

Peak value detecting portion 45 receives phase difference between speed present value Vnow and current instruction value Iref detected at phase difference detecting portion 43 and phase instruction value Pref calculated at position instructing portion 31, and detects a peak value of position instruction value Pref when phase difference is 0. Peak value detecting portion 46 receives phase difference between speed present value Vnow and current instruction value Iref detected at phase difference detecting portion 43 and position present value Pnow detected at position sensor 5, and detects peak value of position present value Pnow when phase difference is zero.

Subtracter 47 calculates difference between peak value of position instruction value Pref detected at peak value detecting portion 45 and peak value of position present value Pnow detected at peak value detecting portion 46. Gain control portion 48 adjusts control gain Gi of the equation Iref=Gi* (Vref−Vnow) used in speed control portion 35 so that calculated value of subtracter 47 attains zero. Except these points, the operation is the same as the linear compressor driving apparatus in accordance with the first embodiment, and therefore description thereof is not repeated.

Figure 7:
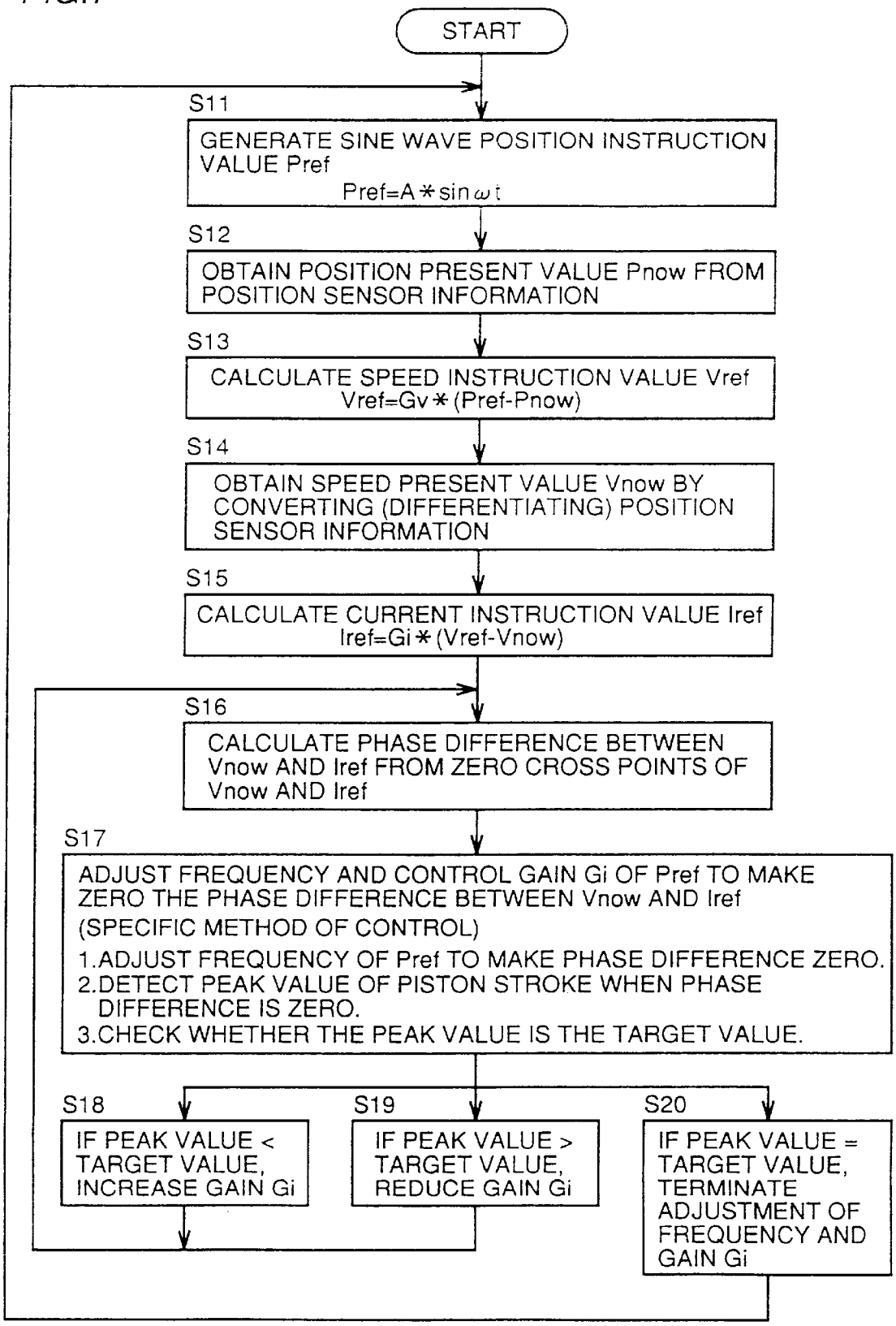
FIG. 7 is a flow chart showing the operation of the control apparatus shown in FIG. 5.

FIG. 7 is a flow chart showing the operation of control apparatus 39 shown in FIGS. 5 and 6. Referring to the flow chart, operation of linear compressor 1 and driving apparatus therefor in accordance with the present embodiment will be described briefly.

First, in step S11, in the same manner as in step S1 of FIG. 4 movable portion of linear motor 20 starts reciprocating motion, thus starting generation of compressed gas.

In step S12, position present value Pnow is detected by position sensor 5, and detected position present value Pnow is applied to P-V converting portion 30, subtracter 32 and phase control portion 40. In step S13, speed instruction value Vref=Gv* (Pref−Pnow) is calculated by position control portion 33, and in step S14, position present value Pnow is converted to speed present value Vnow by P-V converting portion 30. Speed present value Vnow is applied to subtracter 34 and phase control portion 40.

In step S15, current instruction value Iref=Gi* (Vref−Vnow) is calculated in the same manner as in step 5 of FIG. 4 the calculated value Iref is applied to subtracter 36 and phase control portion 40.

In step S16, zero cross points of speed present value Vnow and current instruction value Iref are detected by zero point detecting portions 41 and 42, and phase difference between speed present value Vnow and current instruction value Iref is detected by phase difference detecting portion 43.

In step S17, angular frequency ω of position instruction value Pref is controlled such that phase difference between speed present value Vnow and current instruction value Iref attains to zero, by frequency control portion 44. When phase difference between speed present value Vnow and current instruction value Iref attains to zero, peak value detecting portions 45 and 46 detect peak value (target value) of position instruction value Pref and peak value of position present value Pnow, respectively, in response. Gain control portion 48 determines whether or not the peak value of position present value Vnow is equal to the target value.

When the peak value of position present value Pnow is smaller than the target value, gain control portion 48 increases control gain Gi in step S18, and when the peak value of position present value Pnow is larger than the target value, the gain control portion 48 reduces control gain Gi in step S19.

Steps S16 to S19 are repeated until the peak value of position present value Pnow becomes equal to the target value. In step S20, when the peak value of position present value Pnow becomes equal to the target value, the flow returns to step S11.

Thereafter, steps S11 to S20 are repeated, so that state of operation of linear compressor 1 is stabilized rapidly. Even when there is load variation after activation, thrust of linear motor 20, that is, driving current I is directly and appropriately controlled accordingly, enabling high efficiency.

Of control gain Gv of position control portion 33 and control gain Gi of speed control portion 35, only the control gain Gi is adjusted by phase control portion 40 in the present embodiment. Alternatively, only the control gain Gv may be adjusted, or both of these may be adjusted.

[Third embodiment]

Figure 8:
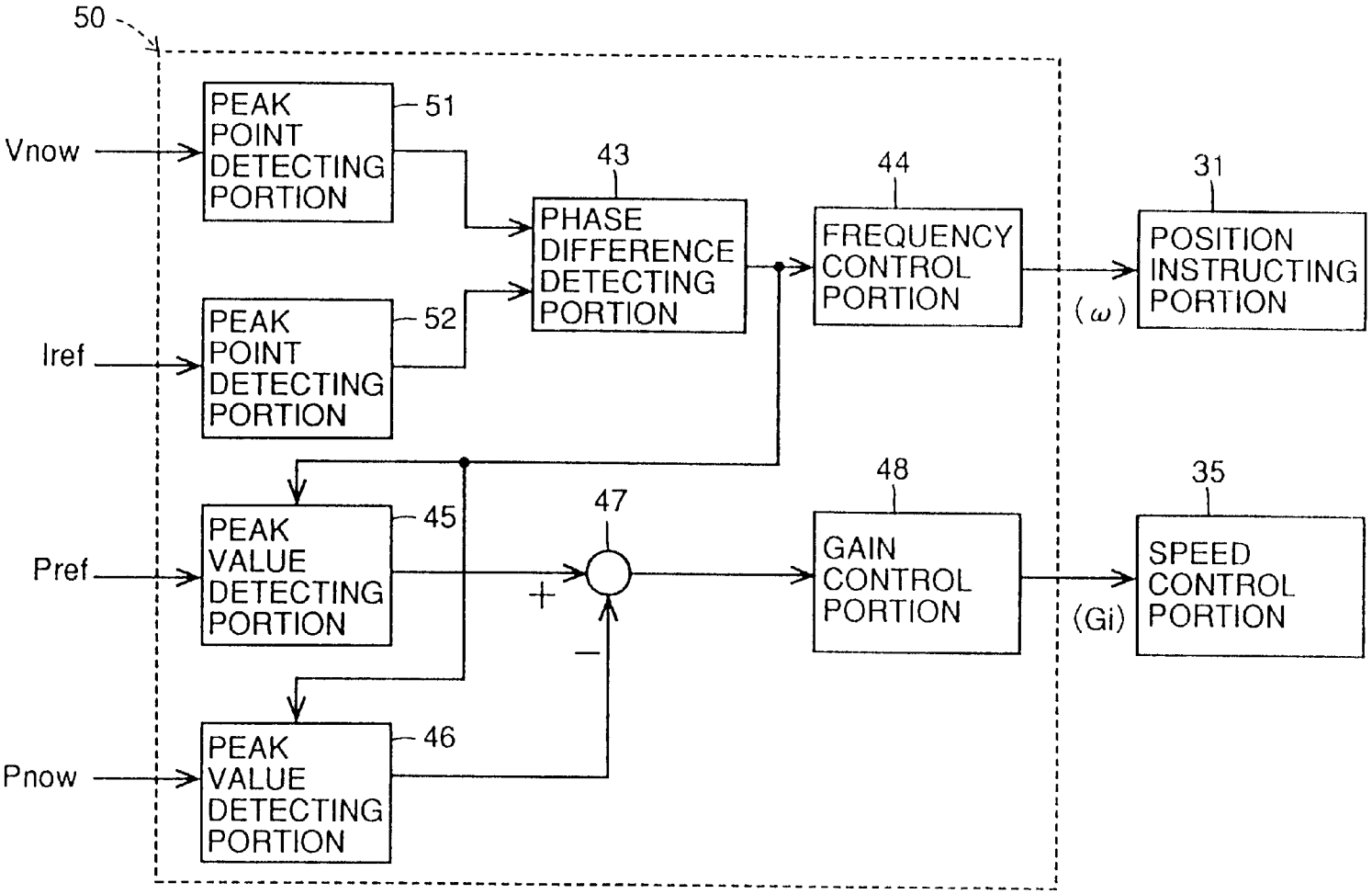
FIG. 8 is a block diagram showing a structure of a phase control portion of the linear compressor driving apparatus in accordance with the third embodiment of the present invention.
Figure 9:
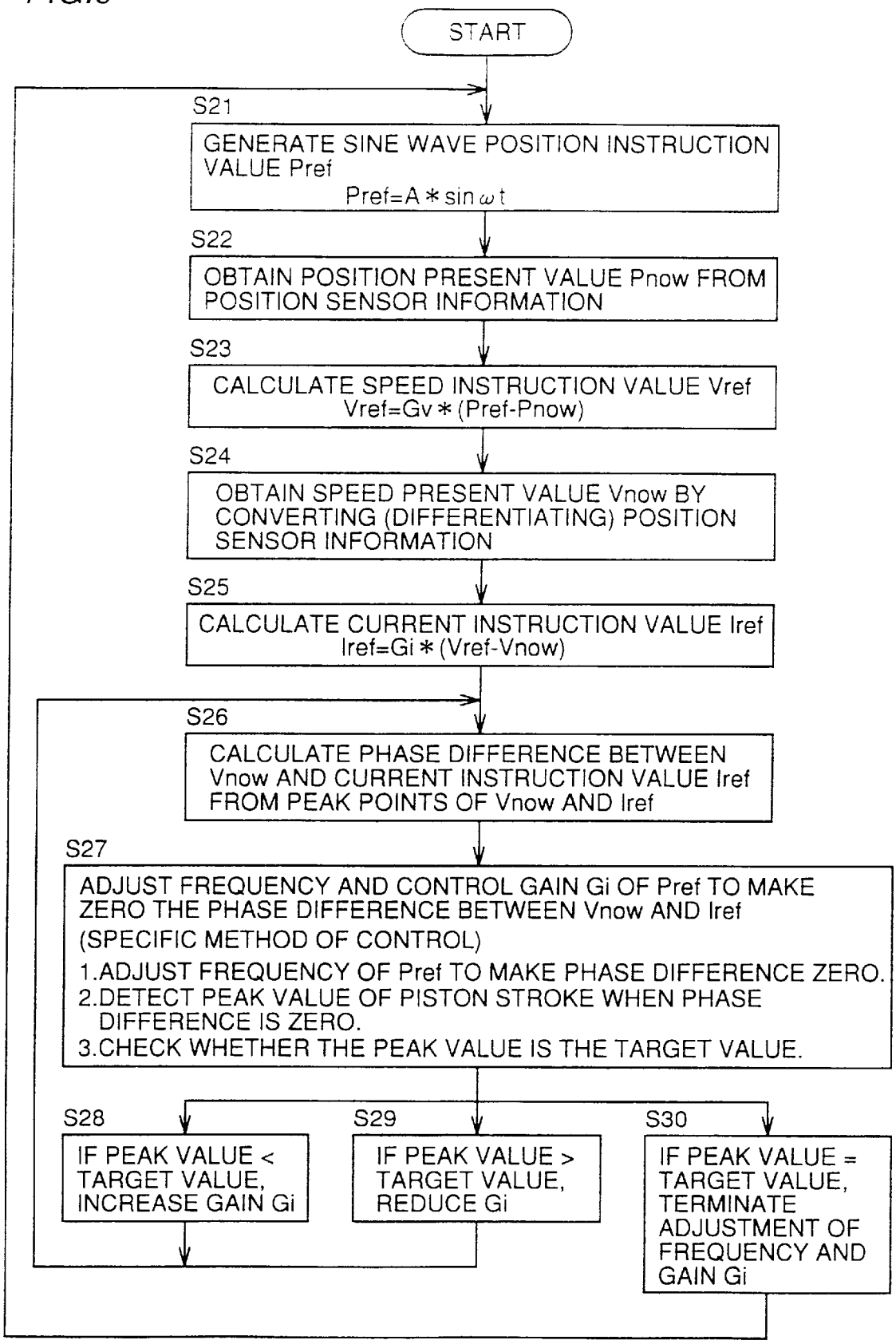
FIG. 9 is a flow chart showing the operation of the control apparatus included in the linear compressor driving apparatus described with reference to FIG. 8.

FIG. 8 shows a structure of a phase control portion 50 of the driving apparatus for linear compressor 1 in accordance with the third embodiment of the present invention, which corresponds to FIG. 6.

Referring to FIG. 8, the phase control portion 50 differs from phase control portion 40 of FIG. 6 in that zero point detecting portions 41 and 42 are replaced by peak point detecting portions 51 and 52, respectively.

Peak point detecting portion 51 detects a peak point of speed present value Vnow generated at P-V converting portion 30. Peak point detecting portion 52 detects a peak point of current instruction value Iref applied from speed control portion 35. Peak point detecting portion 51 samples speed present value Vnow at a period sufficiently smaller than that of speed present value Vnow and detects the fact that the last sampling value is larger than the second last sampling value and that the present sampling value is smaller than the last sampling value, whereby it detects that the speed present value Vnow has passed the peak point. Peak point detecting portion 52 operates in the similar manner.

Phase difference detecting portion 43 detects phase difference between speed present value Vnow and current instruction value Iref in step S26 based on the peak points of speed present value Vnow and of current instruction value Iref. Steps 21 to 25 and 27 to 30 are the same as steps 11 to 15 and 17 to 20 of FIG. 7, respectively, and therefore description thereof is not repeated.

Similar effects as in the second embodiment can be obtained by the present embodiment.

[Fourth Embodiment]

Figure 10:
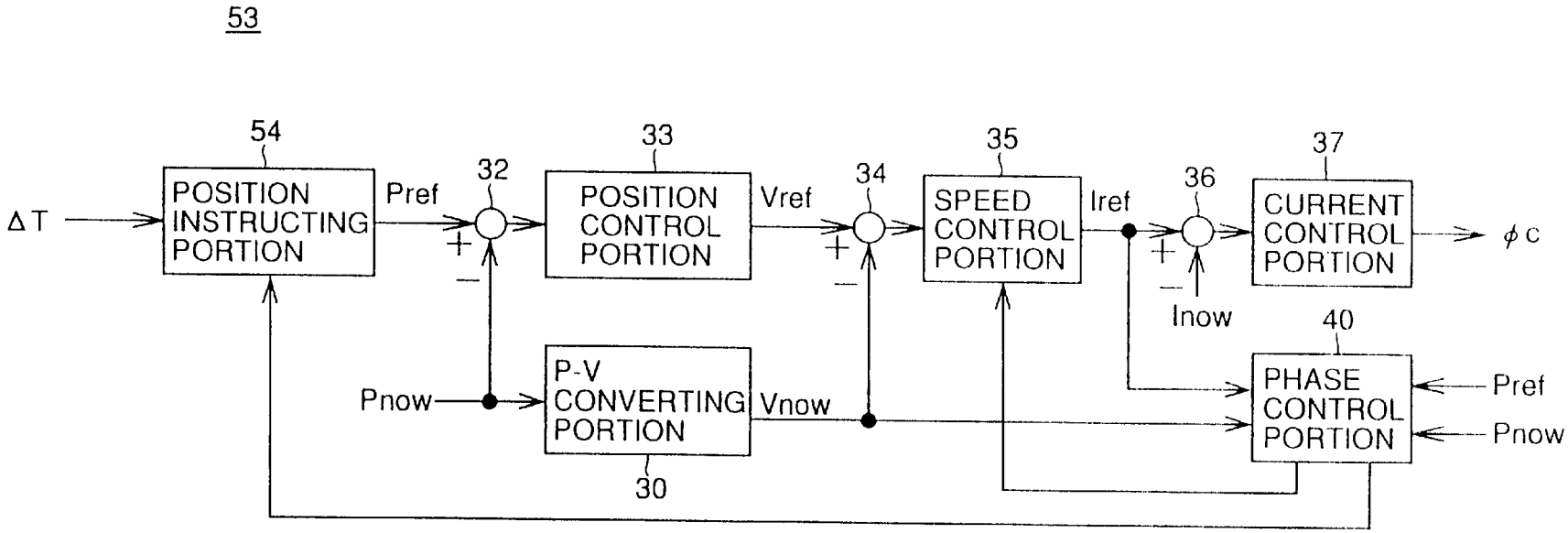
FIG. 10 is a block diagram showing a structure of a control apparatus included in the linear compressor driving apparatus in accordance with the fourth embodiment of the present invention.

FIG. 10 is a block diagram showing a structure of a control apparatus 53 included in the driving apparatus for linear compressor 1 in accordance with the fourth embodiment of the present invention, which corresponds to FIG. 5. Referring to FIG. 10, control apparatus 53 differs from control apparatus 39 of FIG. 5 in that position instructing portion 31 is replaced by a position instructing portion 54.

Position instructing portion 54 calculates a capacity control ratio based on deviation ΔT=Tref−Tnow between target temperature in refrigerator Tref and temperature Tnow in refrigerator applied from a temperature adjusting apparatus (not shown) in a refrigerator and on Table 1 below. The capacity control ratio is represented as a ratio (%) of the output from linear compressor 1 with respect to the maximum output. In linear compressor 1, the output is in proportion to strokes of pistons 12*a* and 12*b*. When the temperature deviation is at least 2° C., the capacity control ratio attains to 100% and if temperature deviation is at most −5° C., the capacity control ratio attains to 0%. Further, position instructing portion 54 calculates strokes of pistons 12*a* and 12*b*, that is, amplitude A, based on the capacity control ratio, generates position instruction value Pref based on the amplitude A, angular frequency ω and the equation Pref=A*sin ωt, and applies the generated position instruction value Pref to subtracter 32.

TABLE 1

| Deviation | Capacity Control Ratio (Max 100%) | Piston Stroke Target Value (% with respect to full stroke) |
|---|---|---|
| At least 2° C. | 100% | 100% |
| At least 0° C. | 75% | 75% |
| At least −2° C. | 50% | 50% |
| At least −5° C. | 25% | 25% |
| At most −5° C. | 0% | 0% |

Figure 11:
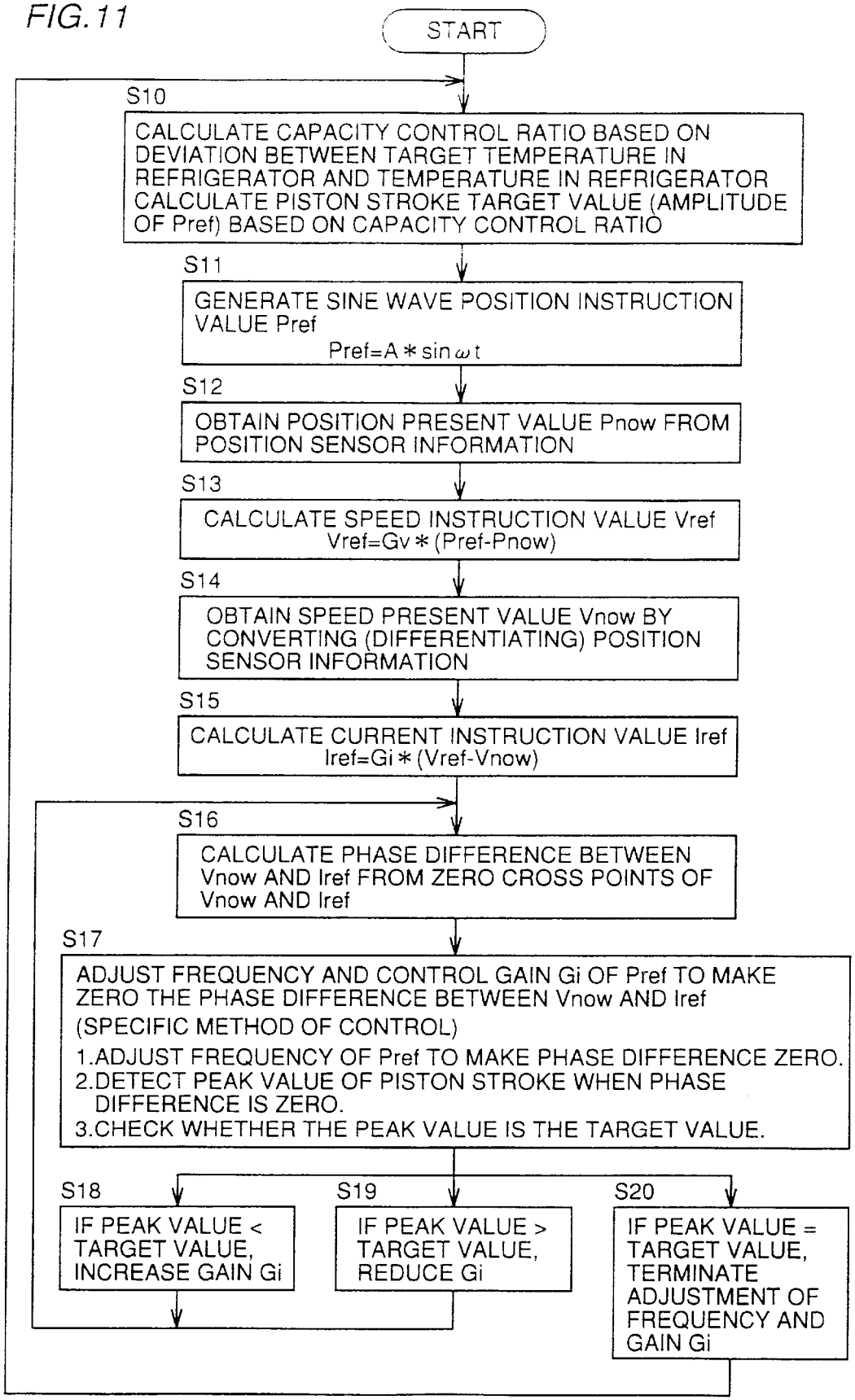
FIG. 11 is a flow chart showing the operation of the control apparatus of FIG. 10.

FIG. 11 is a flow chart showing the operation of control apparatus 53 shown in FIG. 10, which corresponds to FIG. 7.

Referring to FIG. 11, the flow chart differs from the flow chart of FIG. 7 in that before step S11, in step S10, amplitude A of position instruction value Pref is calculated based on the deviation ΔT=Tref−Tnow between target temperature in refrigerator Tref and temperature in refrigerator Tnow by position instruction portion 54.

Other structure and operation are the same as those of the second embodiment, and therefore description thereof is not repeated.

Though the present invention is applied to linear compressor 1 for a refrigerator in the present embodiment, application is not limited thereto, and the present invention is applicable to linear compressor 1 of any application. For example, it is effective for a linear compressor 1 for air conditioning. In that case, linear compressor 1 is controlled based on deviation ΔT=Tref−Tnow between target room temperature Tref and room temperature Tnow.

[Fifth Embodiment]

Figure 12:
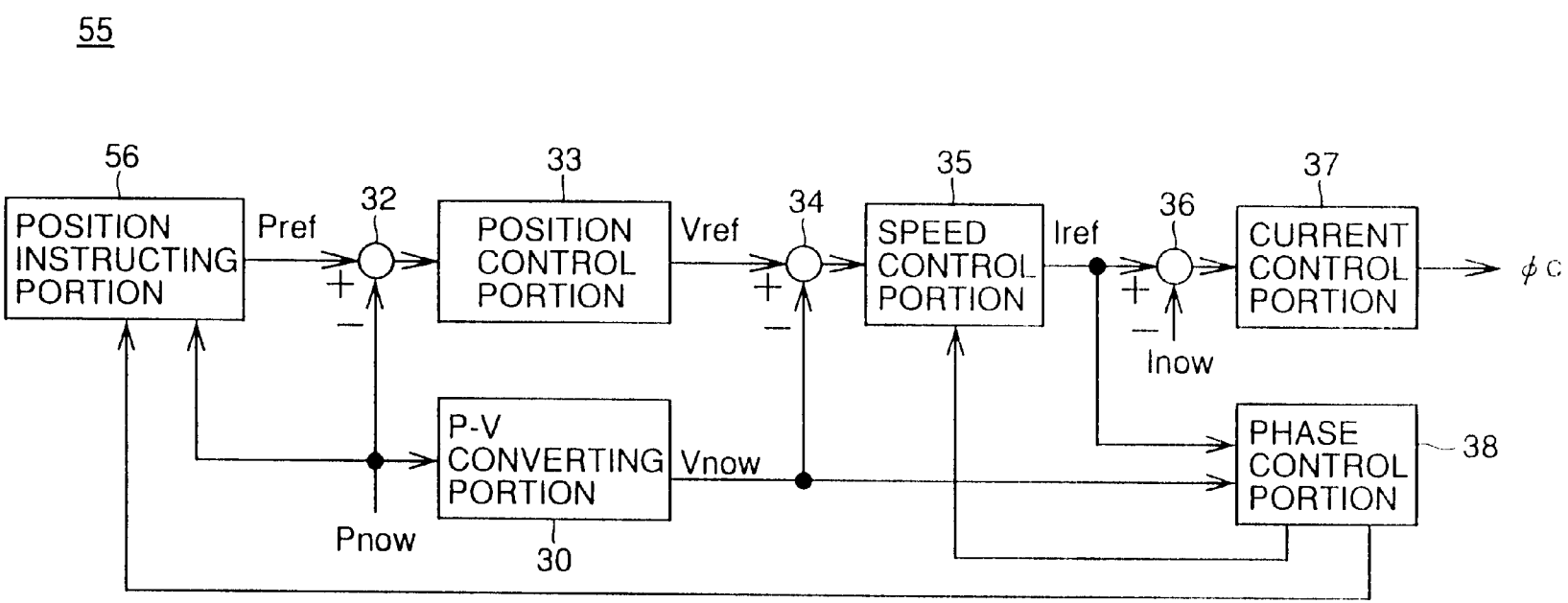
FIG. 12 is a block diagram showing a structure of a control apparatus included in the linear compressor driving apparatus in accordance with the fifth embodiment of the present invention.

FIG. 12 is a block diagram showing a structure of control apparatus 55 included in the driving apparatus for linear compressor 1 in accordance with the fifth embodiment of the present invention, which corresponds to FIG. 3.

Referring to FIG. 12, control apparatus 55 differs from control apparatus 6 of FIG. 3 in that position instructing portion is replaced by position instructing portion 56.

Position instructing portion 56 generates position instruction value Pref based on amplitude A, angular frequency ω and the equation Pref=A*sin ωt. Amplitude A and angular frequency ω are controlled and set in different manners in an activation mode, a steady operation mode and a stopping mode.

Figure 13:
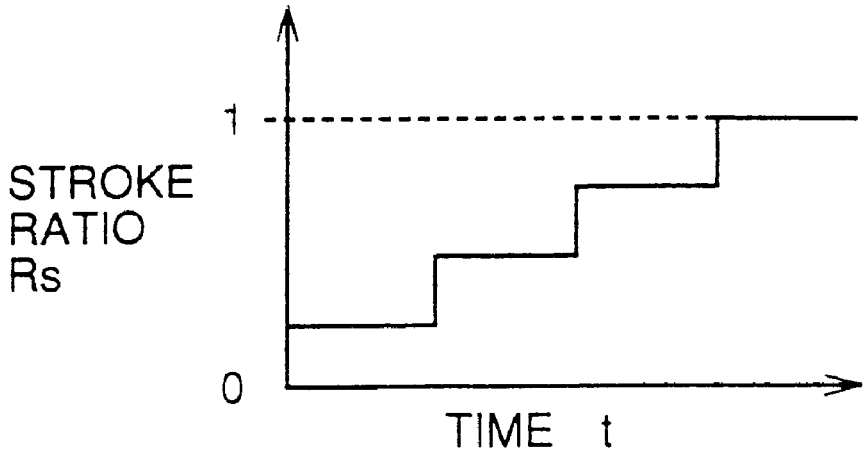
FIG. 13 shows operation of the position instructing portion formed in FIG. 12 at the time of activation.
Figure 14:
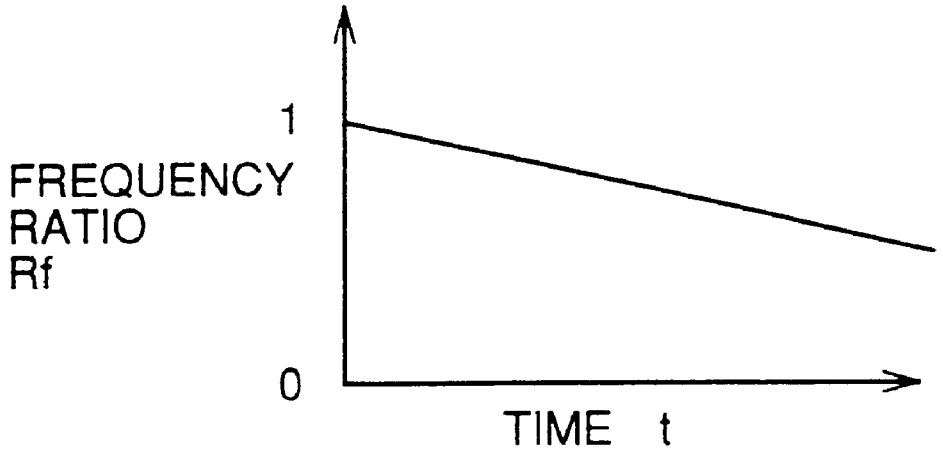
FIG. 14 shows operation of the position instructing portion shown in FIG. 12 at the time of stopping.

More specifically, in the activation mode, frequency f=ω/2π of position instruction value Pref is set to a small value (of 30 Hz, for example) which is about the a resonance frequency where there is no gas load. Thus efficiency is suppressed low and rapid increase in strokes of pistons 12*a* and 12*b* can be prevented. Amplitude A is calculated based on stroke ratio Rs of pistons 12*a*, 12*b*, full stroke Amax and the equation A=Rs*Amax. The stroke ratio Rs is increased stepwise every time variation in peak value of position present value Pnow is settled from 0 to 1, as shown in FIG. 13. The number of steps is set to a value determined in advance on experience.

In the steady operation mode, amplitude A is calculated corresponding to capacity control. For example, if the compressed gas is used for cooling a refrigerator, amplitude A is calculated based on the deviation between target temperature of the refrigerator and temperature of the refrigerator. Angular frequency ω is controlled by phase control portion 38 such that phase of current instruction value Iref matches the phase of speed present value Vnow. Therefore, even when there is load variation, high efficiency is obtained constantly.

In the stopping mode, angular frequency ω is calculated based on frequency ratio Rf, angular frequency ω0 immediately before transition to the stopping mode and the equation ω=Rf*ω0. Frequency ratio Rf is continuously reduced moderately in response to setting of the stopping mode. The inclination of frequency ratio Rf is set in advance to a value calculated based on experience. Consequently, efficiency lowers moderately, and strokes of pistons 12*a* and 12*b* become smaller gradually. When the strokes of pistons 12*a* and 12*b* attain to about one half the full stroke, power source 3 is cut off.

Figure 15:
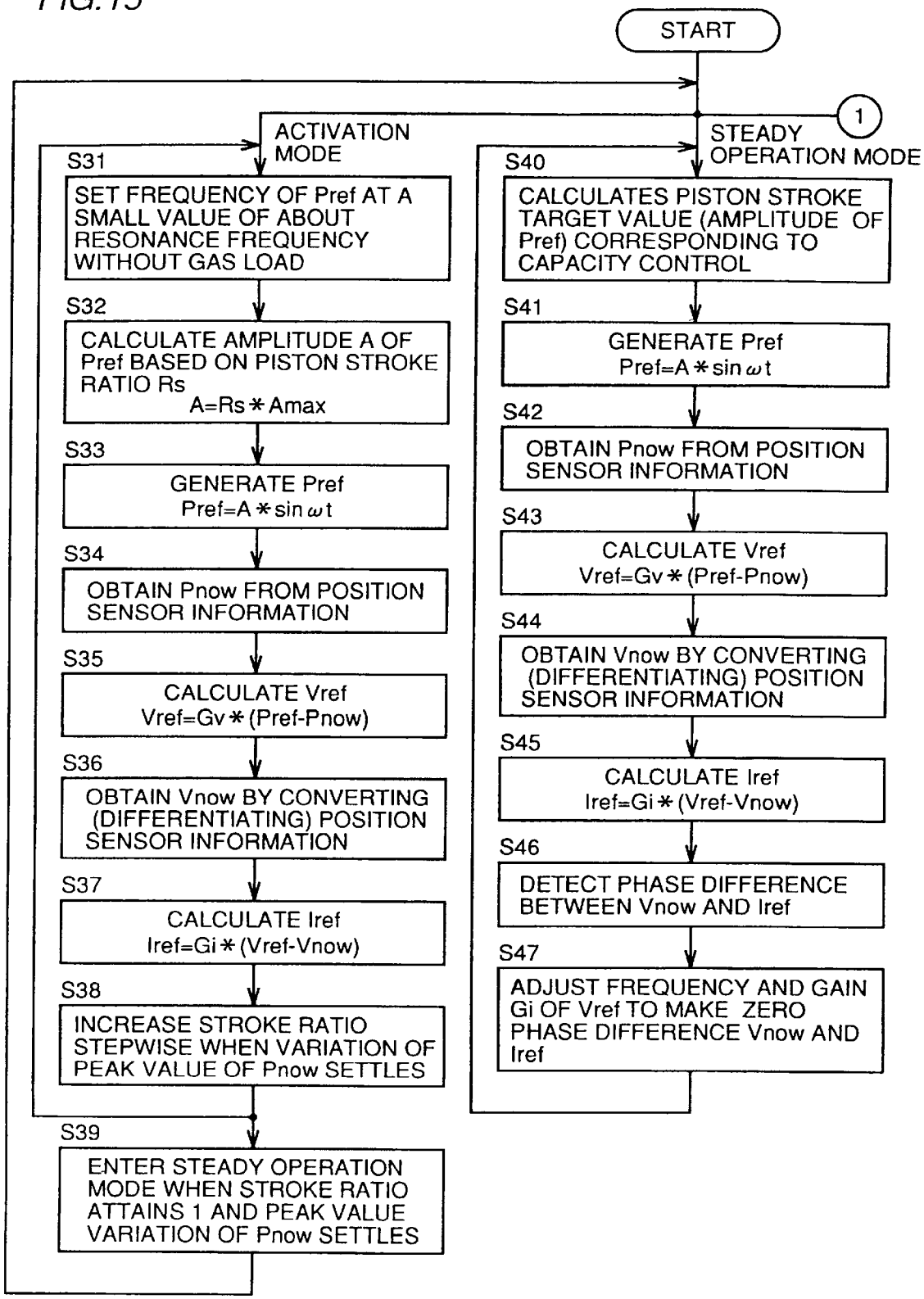
FIG. 15 is a flow chart showing the operation of the control apparatus shown in FIG. 12.
Figure 16:
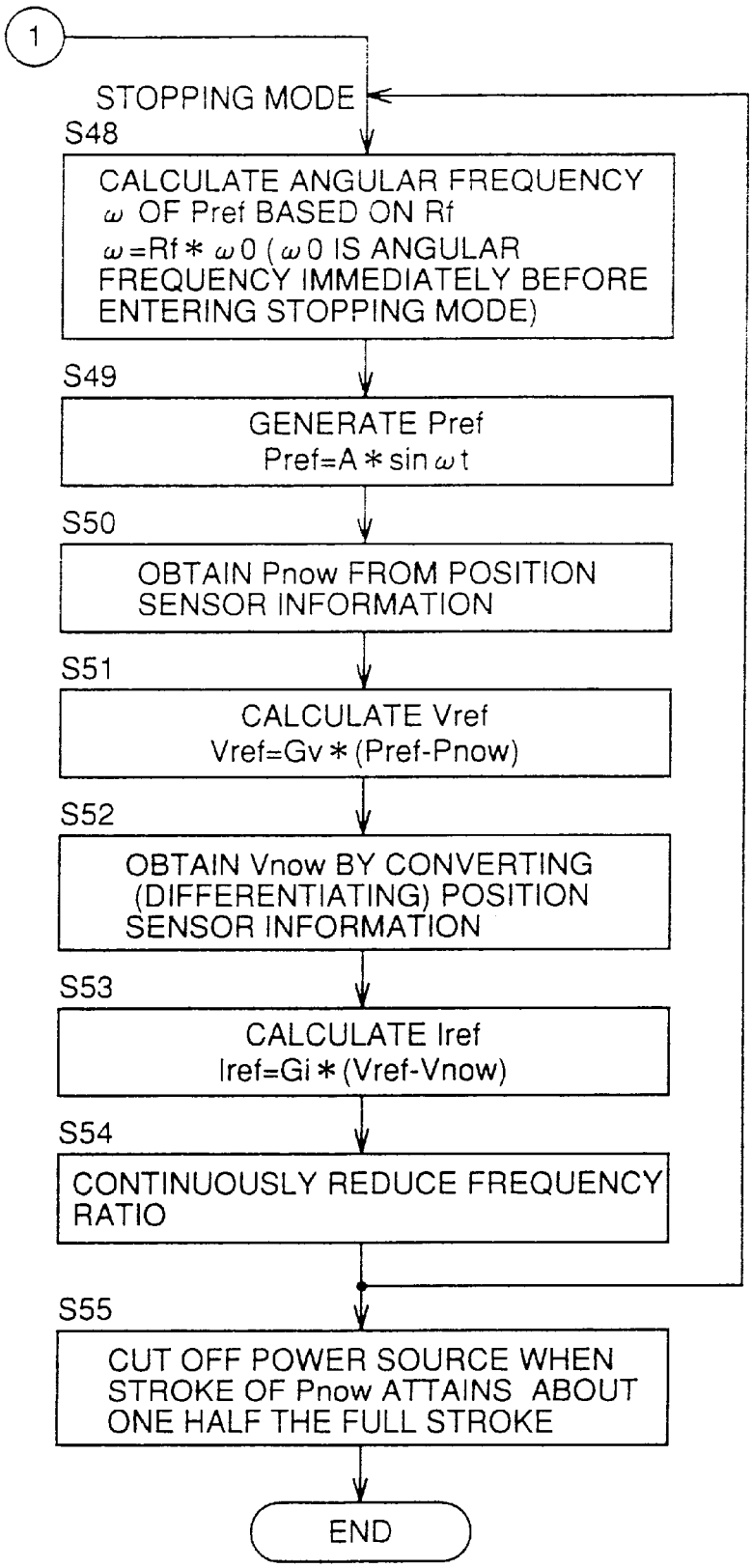
FIG. 16 is a continuation of FIG. 15.

FIGS. 15 and 16 are flow charts showing the operation of control apparatus 55. The operation of linear compressor 1 and driving apparatus therefor in accordance with the present embodiment will be briefly described with reference to the flow chart.

When activation of linear compressor 1 is designated and the activation mode is set, in step S31, frequency of position instruction value Pref is set to a small value of about the resonance frequency without gas load by position instructing portion 56.

In step S32, amplitude A=Rs*Amax of position instruction value Pref is calculated based on the stroke ratio Rs by position instructing portion 56, and in step S33, position instruction value Pref=A*sin ωt is generated by position instructing portion 56.

Control steps S34 to S37 is the same as that of steps S2 to S5. Consequently, when a current is supplied to coil 23 of linear motor 20, movable portion of linear motor 20 starts reciprocating motion, thus starting generation of compressed gas.

In step S38, by position instructing portion 56, stroke ratio Rs is increased by one step when variation of the peak value of position present value Pnow is settled, and steps S31 to S38 are repeated until stroke ratio Rs attains to 1.

In step S39, when stroke ratio Rs attains to 1 and variation of the peak value of position present value Pnow is settled, the activation mode is canceled and steady operation mode is set.

In step S40, amplitude A of position instruction value Pref corresponding to capacity control is calculated by position instructing portion 56. Steps S41 to S45 are the same as steps S33 to S37. More specifically, in step S41, position instruction value Pref=A*sin ωt is generated by position instructing portion 56, position present value Pnow is detected by position sensor 5 in step S42, and speed instruction value Vref is calculated by position control portion 33 in step S43. In step S44, speed present value Vnow is generated by P-V converting portion 30, and current instruction value Iref is calculated by speed control portion 35 in step S45. Power source 3 is controlled so that current present value Inow matches the current instruction value Iref.

In step S46, phase difference between speed present value Vnow and current instruction value Iref is detected by phase control portion 38. In step S47, control gain constant Gi and angular frequency ω of position instruction value Pref are adjusted so that phase difference between speed present value Vnow and current instruction value Iref is eliminated, by phase control portion 38. Thereafter, in the steady operation mode, steps S40 to S47 are repeated.

When stopping of linear compressor 1 is designated, steady operation mode is canceled and stopping mode is set, in step S48, angular frequency ω=Rf*ω0 of position instruction value Pref is calculated based on frequency ratio Rf by position instructing portion 56.

Steps S49 to S53 are the same as steps S33 to S37. More specifically, in step S49, position instruction value Pref= A*sin ωt is generated by position instructing portion 56, in step S50, position present value Vnow is detected by position sensor 5, and in step S51, speed instruction value Vref is calculated by position control portion 33. In step 552, speed present value Vnow is generated by P-V converting portion 30, and in step S53, current instruction value Iref is calculated by speed control portion 35. Power source 3 is controlled such that current present value Inow matches the current instruction value Iref.

In step S54, frequency ratio Rf is continuously and moderately reduced by position instructing portion 56, and steps S48 to S54 are repeated until the stroke of position present value Pnow attains about one half the full stroke.

In step S55, when the stroke of position present value Pnow attains to about one half the full stroke, power source 3 is cut off by position instructing portion 56.

Though angular frequency ω of position instructing value Pref is set to a low value at the time of activation and amplitude A of position instructing value Pref is increased stepwise in the present embodiment, the manner of operation is not limited thereto. At least one of angular frequency ω and amplitude A of position instructing value Vref may be arbitrarily controlled provided that strokes of pistons 12*a* and 12*b* can be increased gradually. For example, angular frequency ω may be set at a value of resonance and frequency A may be increased stepwise.

Though angular frequency ω of position instructing value Pref is reduced moderately at the time of stopping in the present embodiment, it is not limited thereto and at least one of angular frequency ω and amplitude A of position instruction value Pref may be arbitrarily controlled provided that strokes of peaks 12*a* and 12*b* can be reduced gradually. For example, only the amplitude A may be reduced while angular frequency ω is not reduced.

[Sixth Embodiment]

In such a linear compressor, high efficiency is obtained when driving current of the linear motor and the piston speed are in phase, and highest efficiency is obtained when top clearance (closest distance between the piston head and an inner wall end of the cylinder) is maintained at a minimum value (about 0.1 mm).

Therefore, the frequency of the driving current may be controlled such that the phase of driving current of the linear motor matches that of the piston speed. However, if the frequency of the driving current is controlled while the top clearance is maintained small (for example, about 0.1 mm), loss is improved and piston amplitude becomes large, causing the problem of collision of the piston head against the inner wall end of the cylinder.

The amplitude of the piston may be controlled such that the top clearance has the minimum value. However, in a linear compressor having two pistons, actual neutral point of the piston may be offset to the side of upper or lower dead point from the design neutral point (origin) because of asymmetry of a valve or the like. In such a case, it is difficult to control top clearances of two pistons both with high precision.

In the present embodiment, these problems will be solved.

Figure 17:
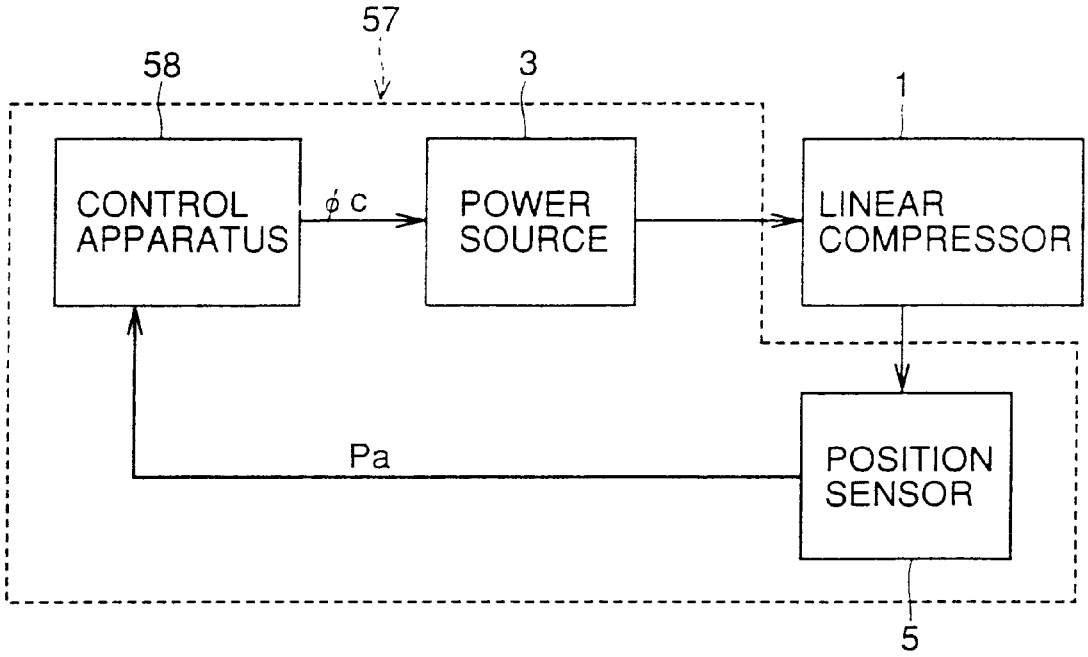
FIG. 17 is a block diagram showing a structure of the linear compressor driving apparatus in accordance with the sixth embodiment of the present invention.

FIG. 17 is a block diagram showing a structure of a driving apparatus 57 for linear compressor 1 in accordance with the sixth embodiment of the present invention.

Referring to FIG. 17, driving apparatus 57 includes power source 3, position sensor 5 and control apparatus 58. Power source 3 supplies driving current I to the linear motor of linear compressor 1. Position sensor 5 directly or indirectly detects position of the piston of linear compressor 1 and outputs an electric signal Pa in accordance with the position of the piston to control apparatus 58. A laser displacement gauge may be used as position sensor 5. Control apparatus 58 outputs a control signal Φc in accordance with output Pa of position sensor 5 to power source 3, and controls output current I of power source 3.

Figure 18:
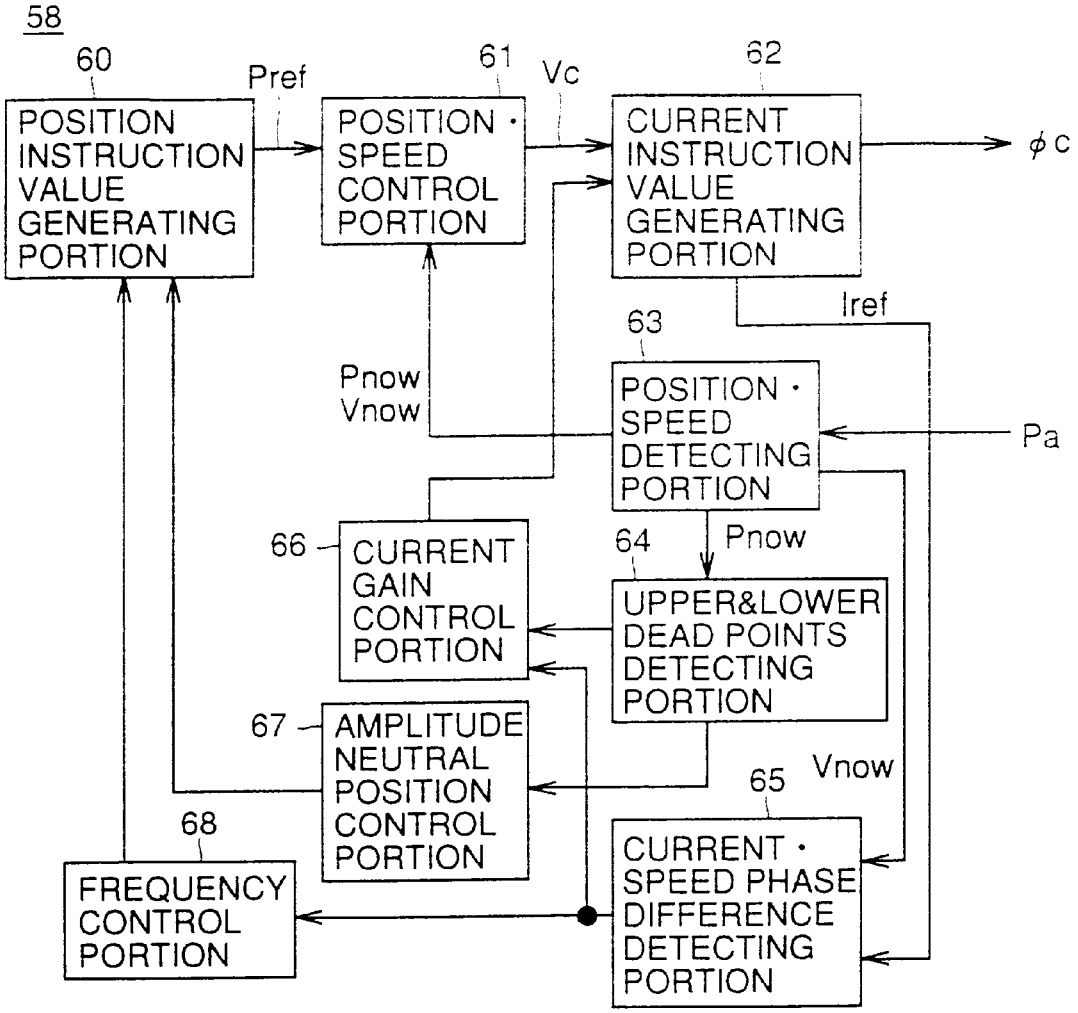
FIG. 18 is a block diagram showing a structure of the main portion of the control apparatus shown in FIG. 17.

FIG. 18 is a block diagram showing a structure of a main portion of control apparatus 58 shown in FIG. 17. Referring to FIG. 18, control apparatus 58 includes a position instruction value generating portion 60, position·speed control portion 61, current instruction value generating portion 62, position-speed detecting portion 63, upper and lower dead points detecting portion 64, current-speed phase difference detecting portion 65, current gain control portion 66, amplitude neutral position control portion 67 and frequency control portion 68.

Position-speed detecting portion 63 samples the output Pa of position sensor 5 at a sampling period (for example, 150 μsec) sufficiently smaller than the vibration period of pistons 12*a*, 12*b*, and generates position present value Pnow by A/D converting the sampled value, and calculates speed present value Vnow by differentiating position present value Pnow.

Upper and lower dead points detecting portion 64 detects amplitude to the side of upper dead point between upper dead point and the origin and the amplitude to the side of lower dead point between the lower dead point and the origin of pistons 12*a* and 12*b* based on the maximum and minimum values of position present value Pnow generated at position-speed detecting portion 63. Detection of amplitude to the sides of upper and lower dead points is performed every time one cycle of position instruction value Pref is completed, that is, every time the position instruction value Pref passes the zero cross point.

Current-speed phase difference detecting portion 65 detects phase difference between speed present value Vnow generated at position-speed detecting portion 63 and current instruction value Iref generated at current instruction value generating portion 62. Detection of the phase difference is performed every time one cycle of position present value Pnow is completed, that is, every time the position present value Pnow passes the zero cross point.

Position instruction value generating portion 60 generates the position instruction value Pref based on a sine table stored in the memory, amplitude A, angular frequency ω, shift amount B and the equation Pref=A sin ωt+B (sine function), and applies the generated position instruction value Pref to position-speed control portion 61.

Position-speed control portion 61 generates speed instruction value Vref based on deviation Pref−Pnow between position instruction value Pref generated at position instruction value generating portion 60 and position present value Pnow generated at position·speed detecting portion 63, and generates speed control value Vc based on deviation Vref−Vnow between speed instruction value Vref and speed present value Vnow generated at position-speed detecting portion 63.

Current instruction value generating portion 62 generates current instruction value Iref based on speed control value Vc generated at position-speed control portion 61, current gain Gi and the equation Iref=GiVc, converts the current instruction value Iref to a control signal Φc and applies it to power source 3. Control of output current I from power source 3 is performed in accordance with PWM method or PAM method, for example.

Current gain control portion 66 compares the amplitude to the side of upper dead point and the amplitude to the side of lower dead point detected by upper and lower dead points detecting portion 64, and larger one of the amplitudes to the sides of upper and lower dead points is regarded as the maximum amplitude present value Anow. The current gain control portion 66 controls the value of current gain Gi used in current instruction value generating portion 62 in every one cycle of vibration of pistons 12*a* and 12*b* so that the maximum amplitude present value Anow becomes equal to a predetermined maximum amplitude target value Aref. Further, current gain control portion 66 determines once in several hundreds (for example, 300) cycles of vibration of pistons 12*a* and 12*b* whether the phase difference detected at current-speed phase difference detecting portion 65 exceeds a predetermined tolerance, and if it exceeds, reduces the value of current gain Gi used in current instruction value generating portion 62 by several percents (%). Since maximum amplitude is controlled in addition to position and speed control by position·speed control portion 61 and current gain Gi is reduced by several percents prior to frequency control, collision of heads of pistons 12*a* and 12*b* against inner wall ends of cylinders 11*a* and 11*b* can surely be avoided.

Amplitude neutral position control portion 67 compares the amplitude to the side of the upper dead point and the amplitude to the side of the lower dead point detected by upper and lower dead points detecting portion 64, and controls shift amount B used in position instruction value generating portion 60 every time one cycle of position instruction value Pref is completed such that difference between the amplitudes to the sides of upper and lower dead points becomes smaller. More specifically, when the amplitude to the side of upper dead point is larger than the amplitude to the side of lower dead point, amplitude neutral position control portion 67 corrects the shift amount B to a negative side (lower direction), and when the amplitude to the side of upper dead point is smaller than the amplitude to the side of lower dead point, corrects the shift amount B to a positive side (upper direction). Since shift amount B is approximately constant because of the characteristics of the apparatus such as asymmetry of valves, the amount of control of shift amount B at one time is set to a small value (for example, 1μ). As the shift amount B is controlled in this manner, top clearances of two pistons 12*a* and 12*b* can be similarly controlled with high precision.

Frequency control portion 66 determines whether the phase difference detected by current-speed phase difference detecting portion 65 exceeds a predetermined tolerance, and if it exceeds, corrects angular frequency ω used in position instruction value generating portion 60 so that phase difference is eliminated. Correction of the phase difference is performed approximately at the same time as reduction of current gain Gi by several percents by current gain control portion 66. Consequently, collision of heads of pistons 12*a* and 12*b* against the inner wall ends of cylinders 11*a* and 11*b*, caused by increased amplitude of pistons 12*a* and 12*b* as the efficiency is improved by phase difference correction, can be prevented.

Figure 19:
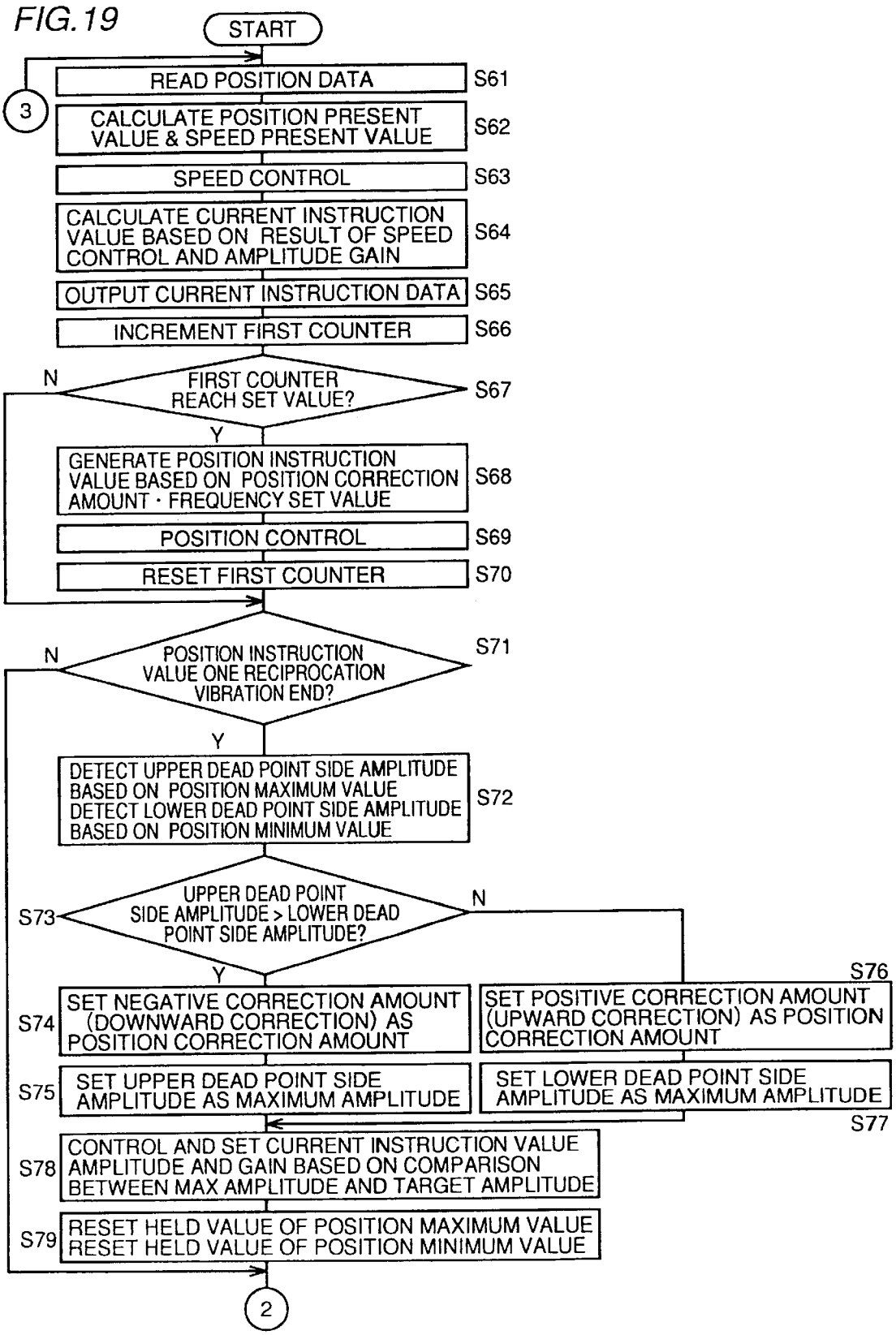
FIG. 19 is a flow chart showing the operation of the control apparatus shown in FIG. 18.
Figure 20:
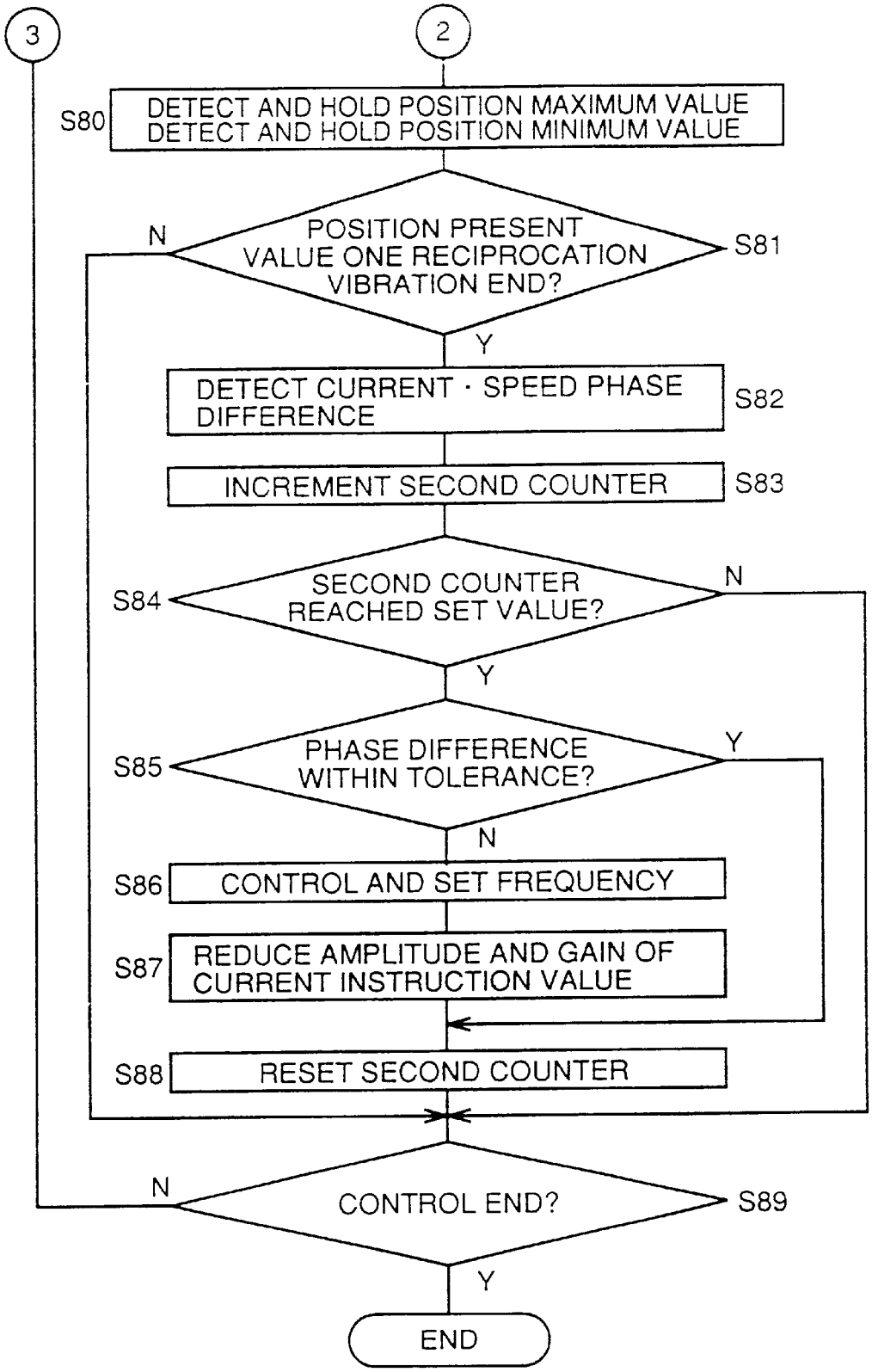
FIG. 20 is a continuation of FIG. 19.

FIGS. 19 and 20 are flow charts showing the operation of control apparatus 58 of FIG. 18. Operation of linear compressor 1 and driving apparatus 57 therefor in accordance with the present embodiment will be described with reference to the flow charts.

First, position instruction value Pref is generated at position instruction value generating portion 60, speed control value Vc is generated at position-speed control portion 61, and control signal Φc is generated at current instruction value generating portion 62. When current is supplied to coil 23 of linear motor 20 from power source 3, movable portion of linear motor 24 starts reciprocating motion, thus starting generation of compressed gas.

In step S61, position data, that is, output Pa of position sensor 5 is read by position-speed detecting portion 63, and in step S62, position present value Pnow and speed present value Vnow are calculated by position-speed detecting portion 63.

In step S63, speed control is performed by position·speed control portion 61. More specifically, position·speed control portion 61 generates speed control value Vc based on deviation between speed instruction value Vref and speed present value Vnow, and applies it to current instruction value generating portion 62.

In step S64, current instruction value Iref which is a product of speed control value Vc and current gain Gi is generated by current instruction value generating portion 62, and in step S65, current instruction data in accordance with current instruction value Iref, that is, control signal Φc is output from current instruction value generating portion 62 to power source 3.

In step S66, count value of a first counter (not shown) included in control apparatus 58 is incremented (+1), and in step S67, whether the count value of the first counter has reached a set value (for example 3) is determined.

If the count value of the first counter has reached the set value in step S67, in step S68, amplitude A and angular frequency ω are generated based on the position correction amount and frequency set value in position instruction value generating portion 60, and further, position instruction value Pref=A sin ωt+B is generated based on the sine table, amplitude A, shift amount B and angular frequency ω. In step S69, position control is performed by position-speed control portion 61. More specifically, position-speed control portion 61 generates speed instruction value Vref based on deviation between position instruction value Pref and position present value Pnow. After completion of position control, in step S70, count value of the first counter is reset.

In step S67, if the count value of the first counter has not yet reached the set value, steps S68 to S70 are not performed.

In step S71, whether one cycle of position instruction value Pref is completed or not is determined.

In step S71, if it is determined that one cycle of position instruction value Pref is completed, in step S72, amplitude to the side of the upper dead point and amplitude to the side of the lower dead point of pistons 12*a* and 12*b* are detected by upper and lower dead points detecting portion 64 based on the maximum and minimum values of position present value Pnow.

In step S73, magnitude of the amplitudes to the sides of upper and lower dead points are compared, and when the amplitude to the side of the upper dead point is larger than the amplitude to the side of lower dead point, in step S74, a negative correction amount is set as the correction amount of shift amount B by amplitude neutral position control portion 67, and in step S75, the amplitude to the side of upper dead point is set as the maximum amplitude present value Anow.

When the amplitude to the side of lower dead point is larger than the amplitude to the side of the upper dead point as a result of magnitude comparison in step S73, a positive correction amount is set as the correction amount of shift amount B by amplitude neutral position control portion 67 in step S76, and the amplitude to the side of lower dead point is set as the maximum amplitude present value Anow in step S77.

In step S78, current gain Gi is controlled and set such that the maximum amplitude present value Anow matches the maximum amplitude target value Aref by current gain control portion 66, and thereafter, maximum and minimum values of position present value Pnow are reset in upper and lower dead points detecting portion 64 in step S79.

If it is determined in step S71 that one cycle of position instruction value Pref is completed, steps S72 to S79 are not performed.

Thereafter, in step S80, detection and holding of maximum and minimum values of position present value Pnow are performed by upper and lower dead points detecting portion 64. In step S81, whether one cycle of position present value Pnow is completed or not is determined by current·speed phase difference detecting portion 65.

If it is determined that one cycle of position present value Pnow is completed in step S81, phase difference between current instruction value Iref and phase present value Vnow is detected by current-speed phase difference detecting portion 65 in step S82.

Thereafter, in step S83, count value of a second counter (not shown) is incremented, and in step S84, whether or not the count value of the second counter 2 has reached a set value (300) is determined.

If it is determined in step S84 that the count value of the second counter has reached the set value, in step S85, whether the phase difference between current instruction value Iref and speed present value Vnow is within the tolerance is determined.

If it is determined in step S85 that the phase difference is out of tolerance, in step S86, control and setting of frequency of position instruction value Pref is performed by frequency control portion 68, and in step S87, current gain Gi of current instruction value Iref is reduced by several percents by current gain control portion 66.

When it is determined in step S85 that the phase difference is within the tolerance, steps S86 and S87 are not performed.

Thereafter, in step S88, count value of the second counter is reset. If it is determined in step S81 that one cycle of position present value Pnow has not yet been completed, steps S82 to S88 are not performed. If it is determined in step S84 that the count value of the second counter has not yet reached the set value, steps S85 to S88 are not performed.

Thereafter, in step S89, whether control is completed or not is determined and if it is determined that the control is completed, the control ends. If not, the flow returns to step S61.

In the present embodiment, when frequency of position instruction value Pref is controlled to eliminate phase difference between current instruction value Iref and speed present value Vnow, current gain Gi of current instruction value Iref=GiVc is reduced by several percents. Therefore, even if the loss is improved by the frequency control of position instruction value Pref and amplitude of pistons 12*a* and 12*b* are increased, collision of heads of pistons 12*a* and 12*b* against inner wall ends of cylinder 11*a* and 11*b* can be avoided.

Further, current gain Gi of current instruction value Iref is controlled such that larger one of the amplitudes to the sides of upper and lower dead points of pistons 12*a* and 12*b* is positioned at the maximum amplitude target value Aref, and therefore even when actual neutral point of pistons 12*a* and 12*b* is shifted from the designed neutral point (origin), collision of heads of pistons 12*a* and 12*b* against inner wall ends of cylinders 11*a* and 11*b* can be prevented.

Further, shift amount B of the actual neutral point of pistons 12*a* and 12*b* from the origin is detected and the shift amount B of position instruction value Pref is controlled to eliminate the shift amount B, and therefore head clearances of two pistons 12*a* and 12*b* can both be similarly controlled with high precision.

In the present embodiment, phase difference between current instruction value Iref and speed present value Vnow is detected by current-speed phase difference detecting portion 65 and frequency of position instruction value Pref is controlled to eliminate the phase difference. However, the manner of control is not limited thereto, and phase difference between current instruction value Pref and position present value Pnow may be detected and frequency of position instruction value Pref may be controlled such that the phase difference attains 90°.

[Seventh Embodiment]

Figure 21:
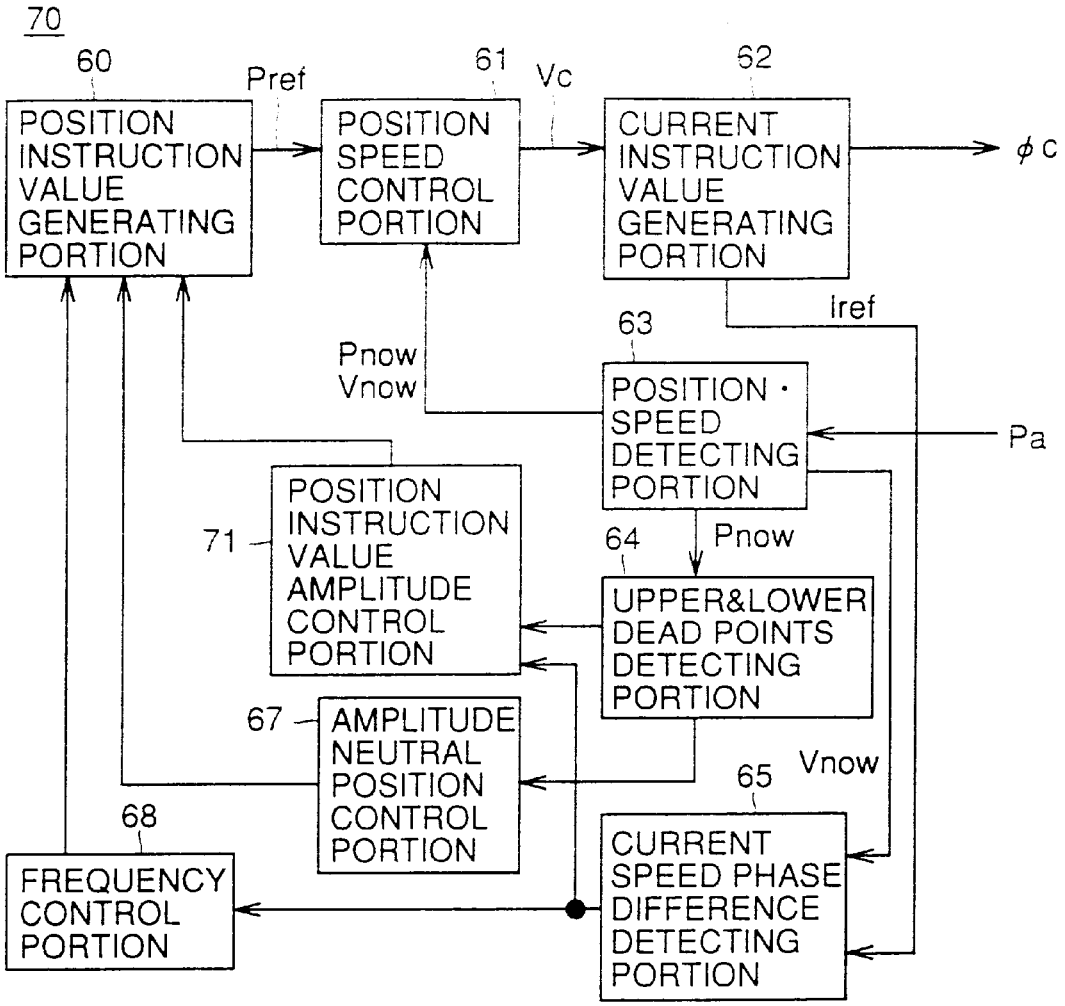
FIG. 21 is a block diagram showing a main portion of the control apparatus of the linear compressor driving apparatus in accordance with the seventh embodiment of the present invention.

FIG. 21 is a block diagram showing a structure of the linear compressor driving apparatus in accordance with the seventh embodiment of the present invention.

Referring to FIG. 21, the linear compressor driving apparatus differs from the sixth embodiment in that control apparatus 58 is replaced by control apparatus 70, and not the current gain Gi of current instruction value Iref but the amplitude A of position instruction value Pref is controlled.

Control apparatus 70 corresponds to control apparatus 58 with the current gain control portion 66 replaced by position instruction value amplitude control portion 71. Position instruction value amplitude control portion 71 compares the amplitude to the side of upper dead point and the amplitude to the side of the lower dead point detected by the upper and lower dead points detecting portion 64, using larger one of the amplitudes to the sides of upper and lower dead points as maximum amplitude present value Anow, and controls the value of amplitude A used in position instruction value generating portion 60 such that the maximum amplitude present value Anow becomes equal to a predetermined maximum amplitude target value Aref, at every one cycle of vibration of pistons 12*a* and 12*b*. Further, phase instruction value amplitude control portion 71 determines once at every several hundreds (for example, 300) cycles of vibration of pistons 12*a* and 12*b* whether the phase difference detected by current-speed phase difference detecting portion 65 exceeds a predetermined tolerance, and if exceeds, reduces the value of amplitude A used in position instruction value generating portion 60 by several percents.

Figure 22:
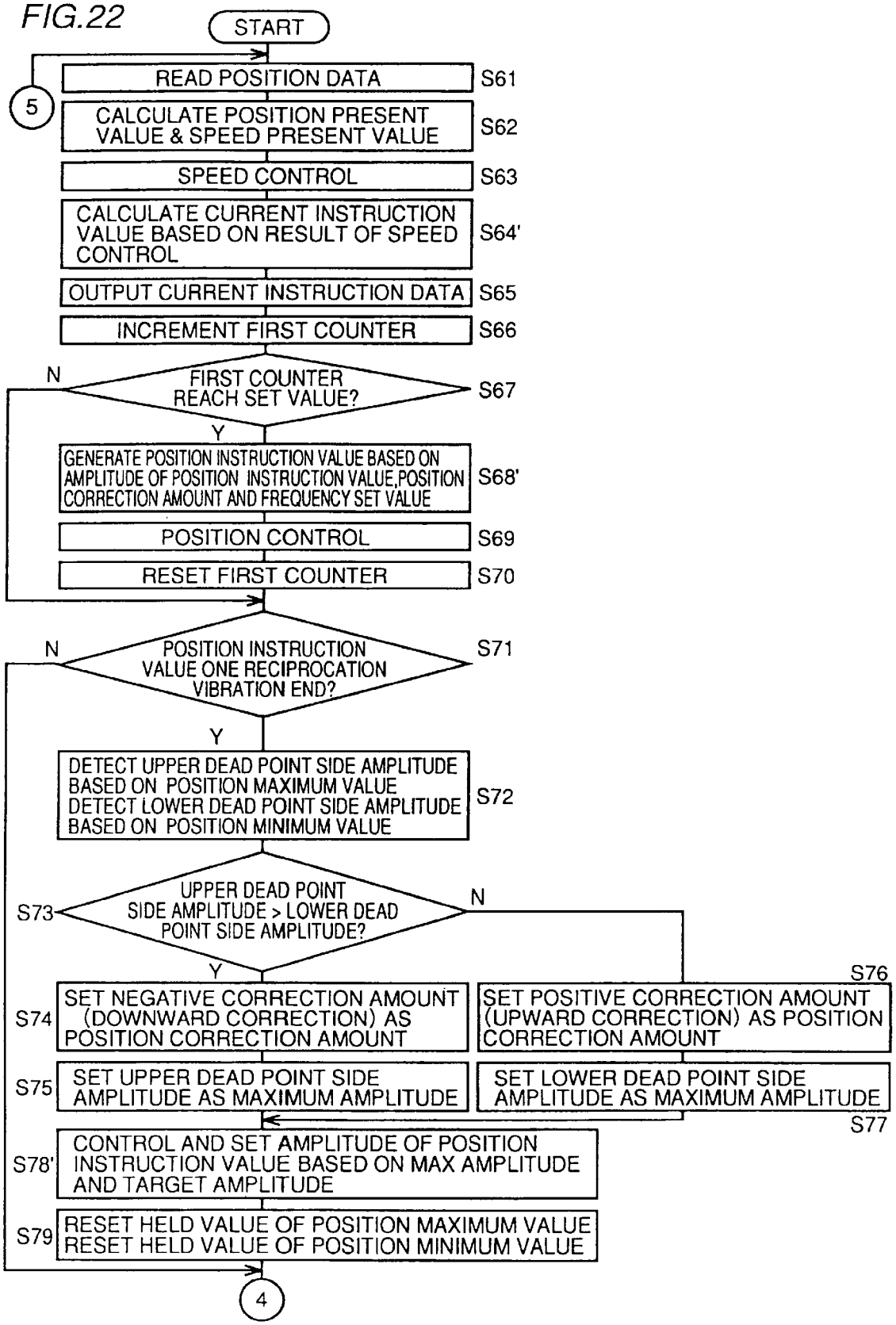
FIG. 22 is a flow chart showing the operation of the control apparatus shown in FIG. 21.
Figure 23:
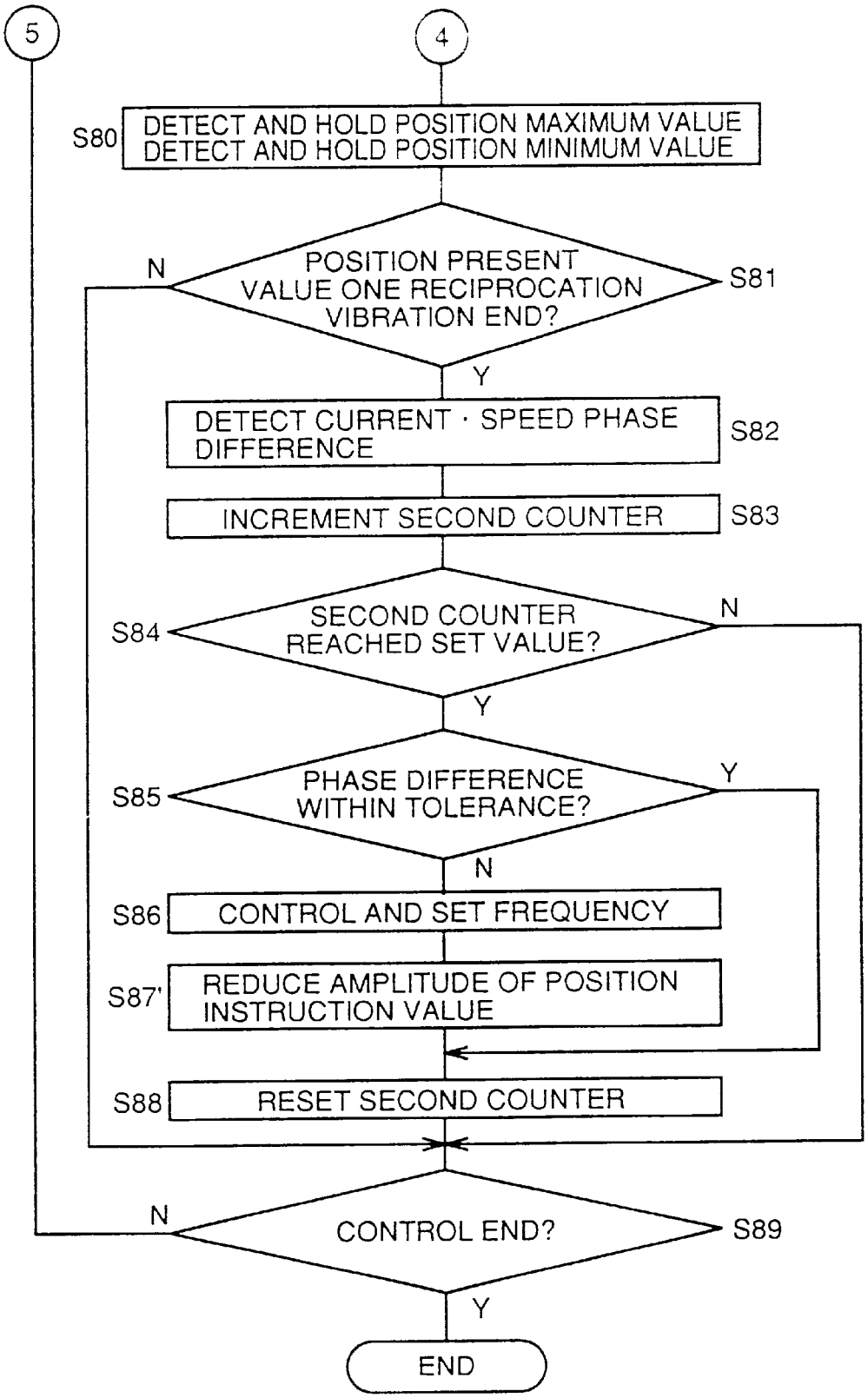
FIG. 23 is a continuation of FIG. 22.

FIGS. 22 and 23 are flow charts showing the operation of the linear compressor driving apparatus shown in FIG. 21.

The flow charts of FIGS. 22 and 23 differ from the flow charts of FIGS. 19 and 20 in that steps S64', S68', S78' and S77' are performed in place of steps S64, S68, S78 and S77.

More specifically, in step S64', current instruction value Iref which is a product of speed control value Vc and current gain Gi is calculated by current instruction value generating portion 62. The current gain Gi is a constant. In step S68', position instruction value Pref=A sin ωt+B is generated by position instruction value generating portion 60. Here, amplitude A, angular frequency ω and shift amount B are variants, respectively.

In step S78', amplitude A of position instruction value Pref is controlled and set such that maximum amplitude present value Anow of pistons 12*a* and 12*b* becomes equal to the maximum amplitude target value Aref by position instruction value amplitude control portion 71. In step S77', amplitude A of position instruction value Pref is reduced by several percents by position instruction value amplitude control portion 71. Other structure and operation are the same as those of the sixth embodiment, and therefore description thereof is not repeated.

In the present embodiment also, similar effects as in the sixth embodiment can be obtained.

[Eighth Embodiment]

Figure 24:
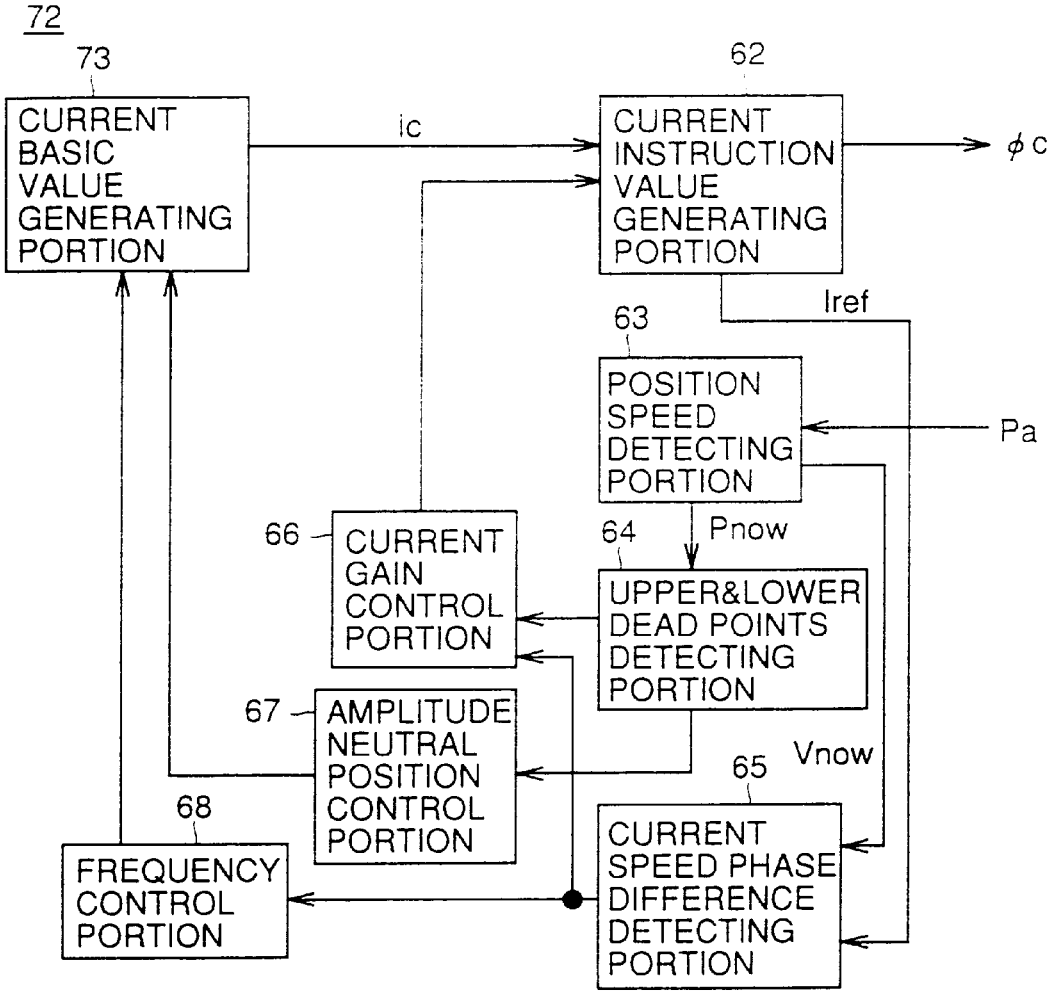
FIG. 24 is a block diagram showing a structure of a main portion of the control apparatus of the linear compressor driving apparatus in accordance with the eighth embodiment of the present invention.

FIG. 24 is a block diagram showing a structure of the linear compressor driving apparatus in accordance with the eighth embodiment of the present invention.

Referring to FIG. 24, the linear compressor driving apparatus differs from that of the sixth embodiment is that control apparatus 58 is replaced by control apparatus 72 and structure is simplified.

In control apparatus 72, the position-speed control portion 61 of control apparatus 58 is removed, and position instruction value generating portion 60 is replaced by current basic value generating portion 73. Current basic value generating portion 73 generates a current basic value Ic based on the sine table stored in the memory, amplitude A', angular frequency ω', shift amount B' and the equation Ic=A' sin ω't+B' (sine function), and applies the generated current basic value Ic to current instruction value generating portion 62.

Current instruction value generating portion 62 generates current instruction value Iref based on current basic value Ic generated at current basic value generating portion 73, current gain Gi and equation Iref=GiIc, converts the current instruction value Iref to control signal Φc and applies it to power source 3.

The amplitude neutral position control portion 67 controls shift amount B' of current basic value Ic instead of shift amount B of position instruction value Pref, and frequency control portion 68 controls frequency of current basic value Ic instead of the frequency of position instruction value Pref.

Figure 25:
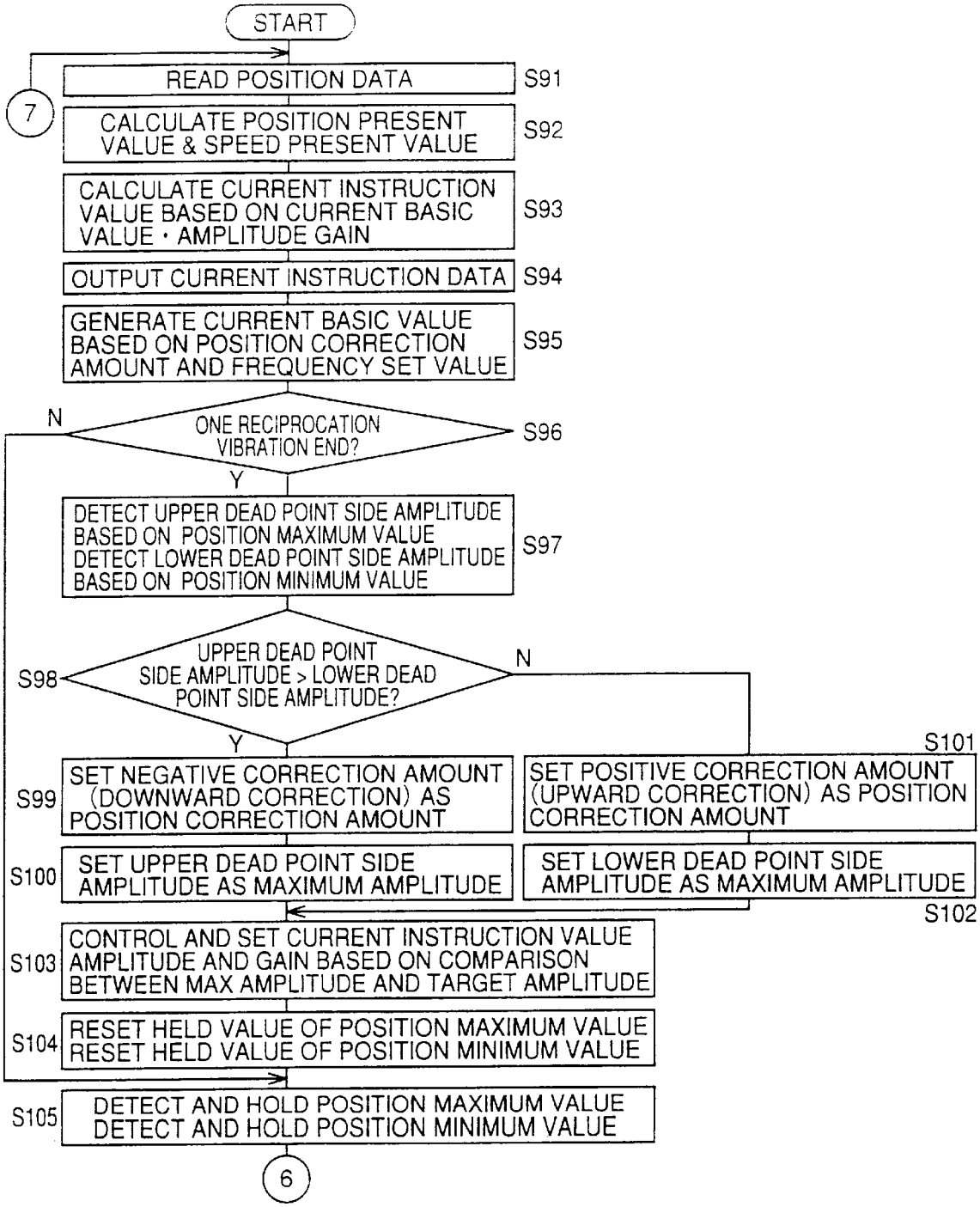
FIG. 25 is a flow chart showing the operation of the control apparatus shown in FIG. 24.
Figure 26:
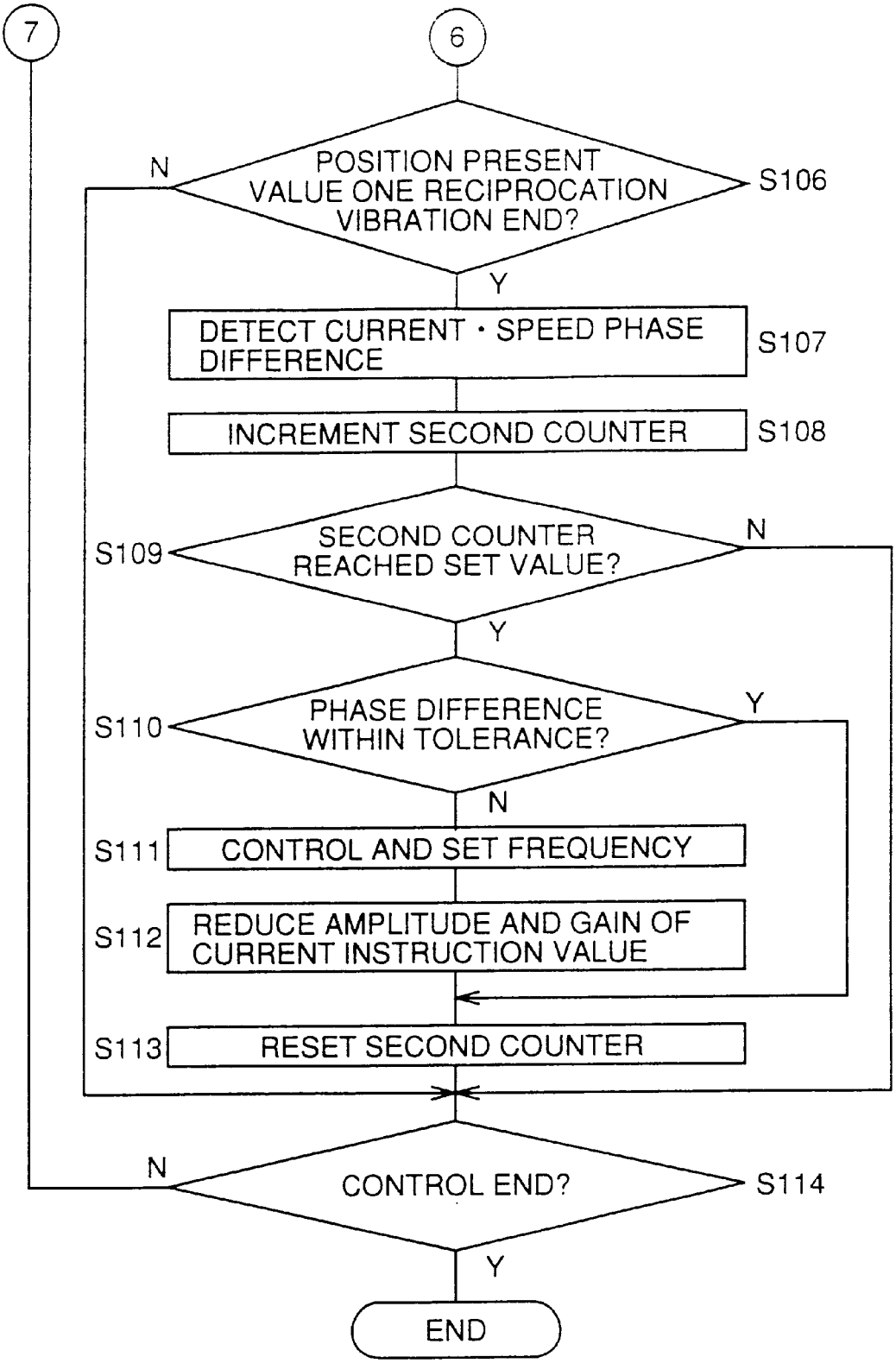
FIG. 26 is a continuation of FIG. 24.

FIGS. 25 and 26 are time charts showing operation of the linear motor driving apparatus shown in FIG. 24.

In step S91, position data, that is, output Pa of position sensor 4 is read by position·speed detecting portion 63, and in step S92, position present value Pnow and speed present value Vnow are calculated by position·speed detecting portion 63.

In step S93, current instruction value Iref, which is a product of current basic value Ic and current gain Gi is generated by current instruction value generating portion 62, and in step S94, current instruction data in accordance with the current instruction value Iref, that is, control signal Φc is output from current instruction value generating portion 62 to power source 3.

Thereafter, in step S95, in current basic value generating portion 73, amplitude A' and angular frequency ω' are generated based on position correction amount and frequency set value, and further, based on the sine table, amplitude A', shift amount B' and angular frequency ω', current basic value Ic=A' sin ω't+B' is generated.

The following steps S96 to S104 are the same as the steps S71 to S89 shown in FIGS. 19 and 20. Therefore, description thereof is not repeated.

In the present embodiment, similar effects as in the sixth embodiment can be obtained and structure of the control apparatus can be simplified.

Though the present invention is applied to a linear compressor 1 having two pistons in the present embodiment, the present invention related to temporary reduction of amplitude in controlling the frequency is also effective in a linear compressor having one piston.

Figure 27:
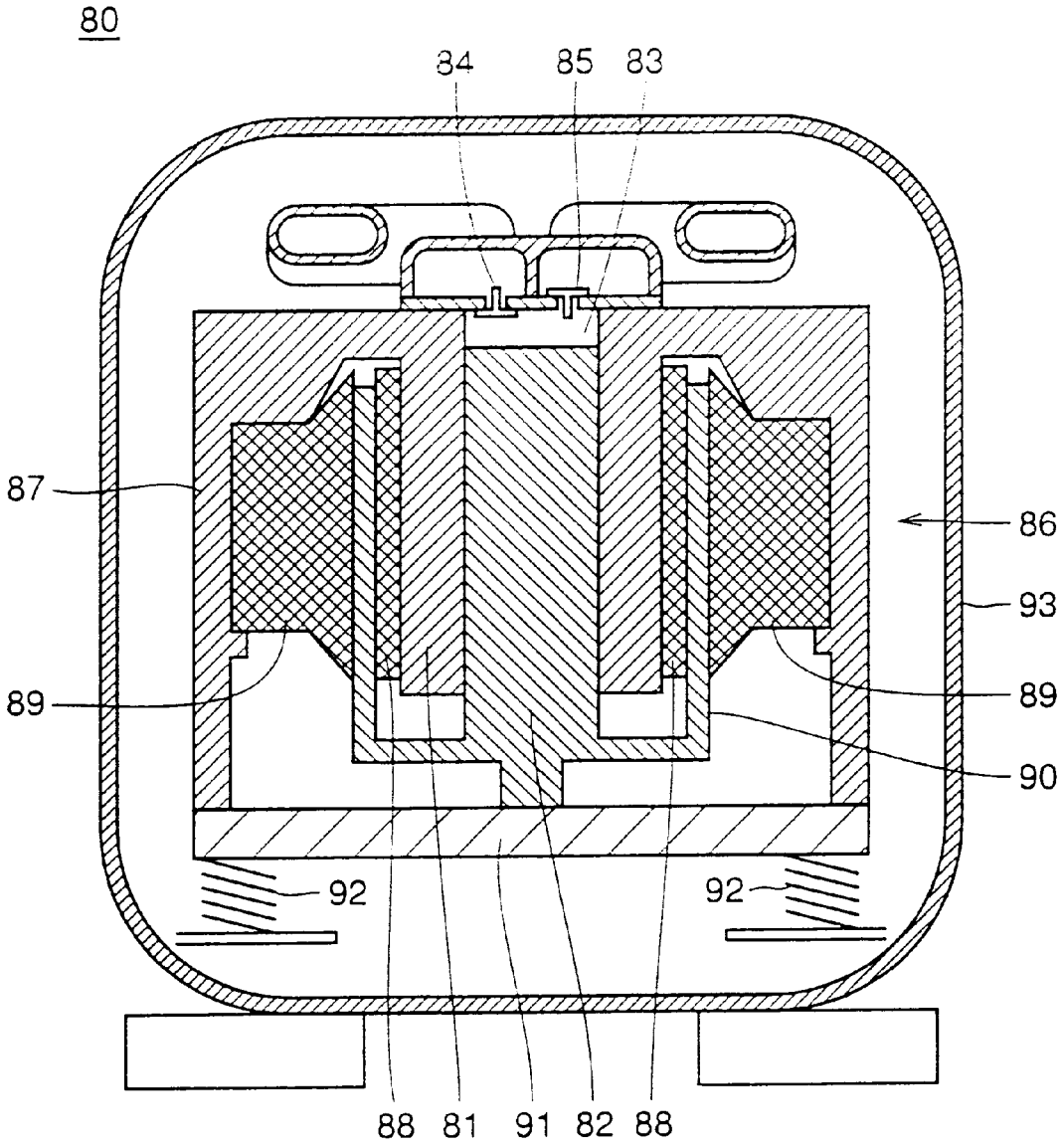
FIG. 27 is a cross section showing an improvement of the linear compressor driving apparatus shown in FIG. 24.

FIG. 27 is a cross section showing a structure of a one piston type linear compressor 80. Referring to FIG. 27, linear compressor 80 includes a cylinder 81, a piston 82 reciprocably fit in cylinder 81, a compression space 83 formed by the head of piston 82 and the inner wall end of cylinder 81, and suction and discharge valves 84 and 85 which are opened/closed in accordance with gas pressure of compression space 83.

Linear compressor 80 further includes a linear motor 86 for reciprocating piston 82, and a piston spring 91 for reciprocably supporting piston 82. Linear motor 86 includes a cylindrical yoke portion 87, stators 88 and 89 having wrapped coils, and a movable body 90 having a cylindrical permanent magnet. Yoke portion 87 is provided concentrically with cylinder 81 and has one end bonded to one end of cylinder 81. Stator 88 is provided on an outer peripheral wall of cylinder 81, while stator 89 is provided on an inner peripheral wall of yoke portion 87. Movable body 90 is reciprocally inserted between stators 88 and 89 and it has one end bonded on one end of piston 82. Peripheral portion of piston spring of 91 is fixed on the other end surface of yoke portion 87 and its central portion fixed on one end of piston 82.

Piston 82 has resonance frequency which is determined based on weights of piston 82 and movable body 90, spring constant of gas spring based on gas pressure variation in compression space 83, spring constant of piston spring 91 and so on. To the coils of stators 88 and 89 of linear motor 86, driving current I of resonance frequency is supplied from power source 3.

These components 81 to 91 are housed in a casing 93 with a mount spring 92 interposed for audio and vibration isolation.

When driving current I is supplied from power source 3 to the coils of stators 88 and 89 of linear motor 86, electromagnetic force acts on the permanent magnet of movable body 90, and movable body 90 and piston 92 reciprocate. By the reciprocating motion of piston 82, expanded gas is sucked in compression space 83 through valve 84, and compressed gas generated in compression space 83 is delivered through discharge valve 85.

Though a coil fixed type linear compressor 80 in which the coil of linear motor 86 is fixed is shown in FIG. 27, coil movable type linear compressor or VCM type linear compressor may be used.

[Ninth Embodiment]

Figure 28:
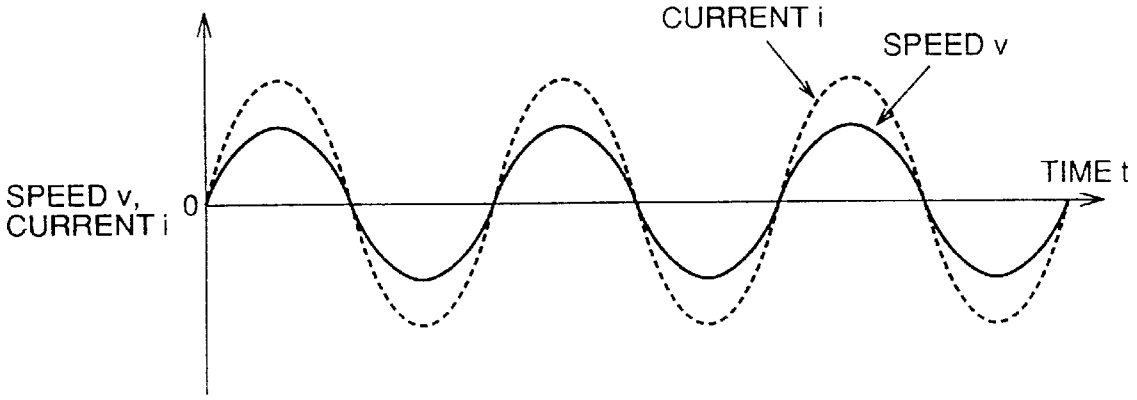
FIG. 28 is a diagram of waveforms showing relation between the speed v of the piston and driving current i when there is not a load in the linear compressor shown in FIG. 27.

In linear compressor 80 of FIG. 27, driving current i is the thrust of linear motor 86, that is, acceleration of piston 82. Therefore, highest efficiency is obtained when the phase of driving current i perfectly matches the phase of speed v of piston 82, as shown in FIG. 28.

However, such a state can be realized only when the linear compressor 80 is operated without any load, or when inductance of the coil is extremely increased by increasing the number of wrapping the coil of linear motor 86.

Figure 29:
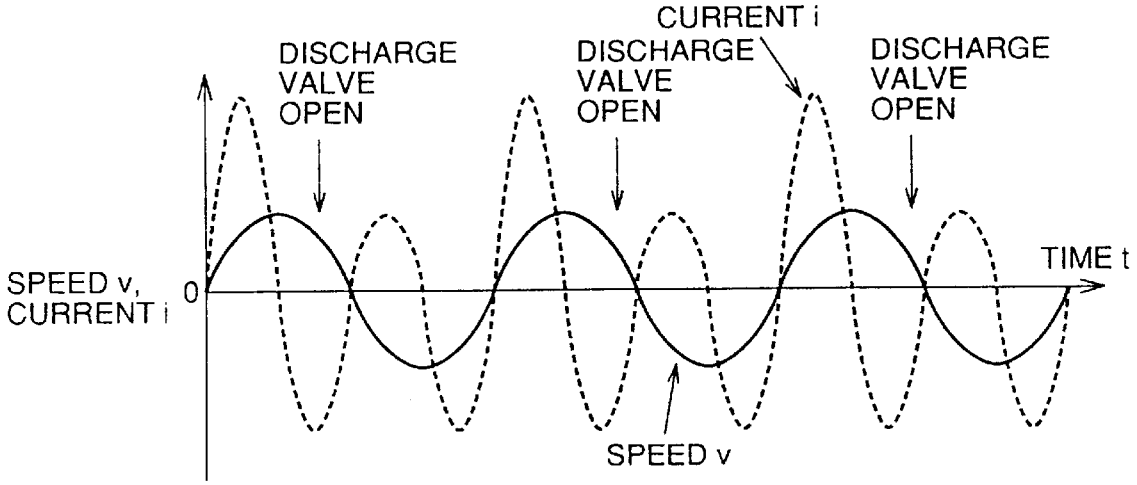
FIG. 29 is a diagram of waveforms showing relation between the speed v of the piston and driving current i when there is a load in the linear compressor shown in FIG. 27.

In normal state of use, load varies much at the moment of opening the discharge valve 85, for example. Therefore, the phase of driving current i is offset from that of speed v of piston 82 as shown in FIG. 29, lowering efficiency.

In a coil movable type linear compressor, increase in number of wrapping the coil of linear motor 86 leads to increased weight of the movable portion, and hence the number of coil wrapping cannot be increased extremely.

The present embodiment solves this problem.

FIG. 27 is a block diagram showing a structure of a driving apparatus for liner compressor 80 in accordance with the ninth embodiment of the present invention.

Figure 30:
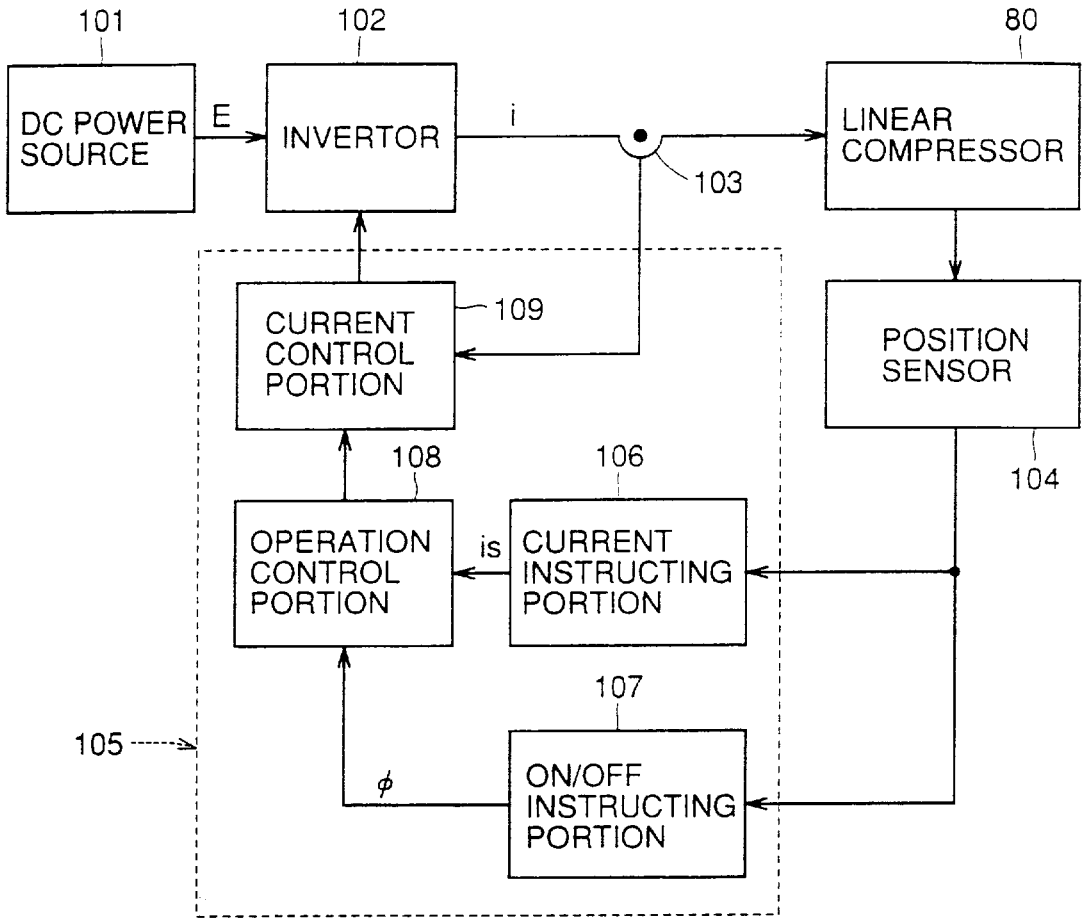
FIG. 30 is a block diagram showing a structure of the linear compressor driving apparatus in accordance with the ninth embodiment of the present invention.

Referring to FIG. 30, the driving apparatus for linear compressor 80 includes a converter and smoothing capacitor portion (DC power source) 101, an inverter 102, a current sensor 103, a position sensor 104 and a control apparatus 105, and the control apparatus 105 includes current instructing portion 106, an on/off instructing portion 107, an operation control portion 108 and current control portion 109.

Figure 31:
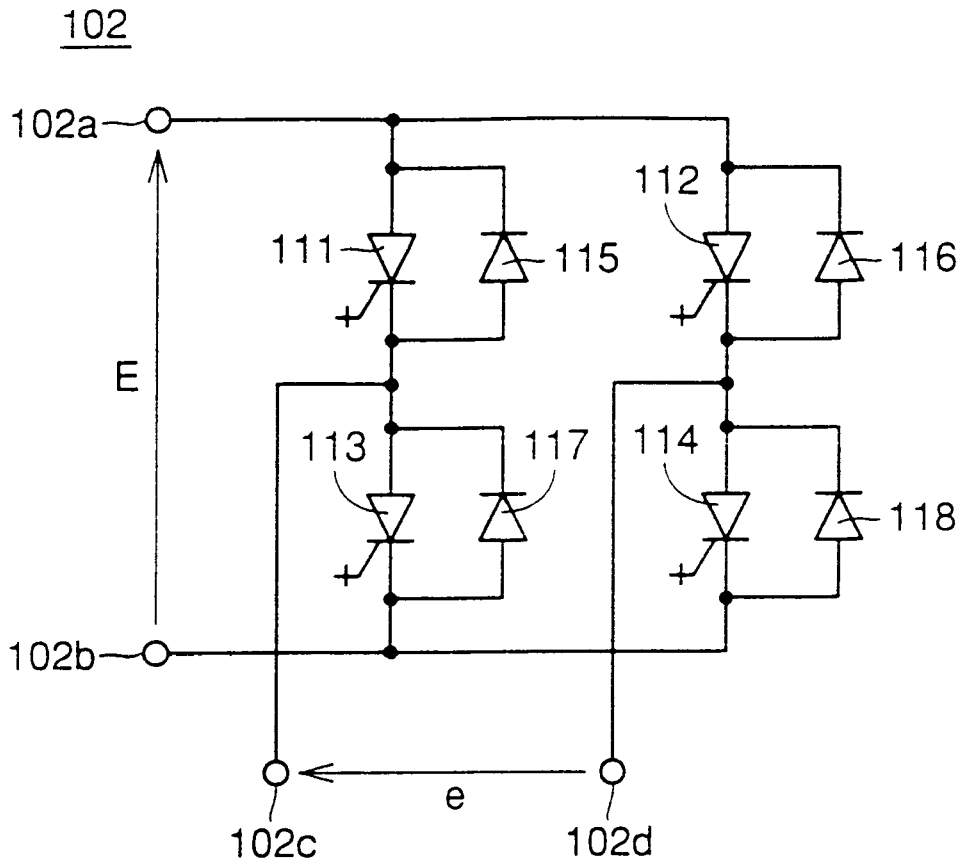
FIG. 31 is a circuit diagram showing a structure of an inverter shown in FIG. 30.

DC power source 101 outputs a prescribed DC voltage E to inverter 102. Inverter 102 is PWM-controlled by current control portion 109 of control apparatus 105, and it converts the DC voltage E to an AC voltage e of the aforementioned resonance frequency, and applies it to linear compressor 80. Inverter 102 includes four sets of gate·turn off·thyristors and feedback diodes 111, 115; 112, 116; 113, 117; 114, 118 connected in the shape of a bridge, as shown in FIG. 31. Output terminals 102*c* and 102*d* are connected to the coil of linear motor 86 of linear compressor 80 through current sensor 103. Voltage e between output terminals 102*c* and 102*d* is controlled such that a current i of sinoidal waveform flows to the coil of linear motor 86.

Current sensor 103 detects output current I of inverter 102, and applies the result of detection to current control portion 109 of control apparatus 105. Position sensor 104 directly or indirectly detects position of piston 82 of linear compressor 80, and applies result of detection to current instructing portion 106 and on/off instruction portion 107 of control apparatus 105. A laser displacement gauge, a linear speed sensor, a Hall element or the like may be used as position sensor 104.

Current instructing portion 106 of control apparatus 105 calculates current instruction value $i_s$ based on the result of detection by position sensor 104 and applies the calculated value to operation control portion 108. Current instructing portion 106 controls current instruction value is in accordance with deviation between the position detected by position sensor 104 and the target position.

On/off instructing portion 107 determines open period of discharge valve 85 based on the result of detection by position sensor 104, calculates on/off instructing value ω based on the result of determination and applies it to operation control portion 108. On/off instructing value ω serves as a signal instructing cutting (current off) of driving current i while the discharge valve 85 is opened, and in other period, it serves as a signal for instructing supply (current on) of driving current i.

Discharge valve opens after the lapse of a prescribed time after the head of piston 82 passes the neutral point as gas pressure in pressure space 83 increases, and it closes when the head of piston 82 starts lowering. Therefore, based on the result of detection by position sensor 104, the open period of discharge valve 85 can be determined.

Operation control portion 108 instructs current off to current control portion 109 in the period when current off is instructed by on/off instructing value Φ from on/off instructing portion 107, and instructs current on to current control portion 109 in the period when current on is instructed by off/on instructing value Φ, and applies current instructing value $i_s$ applied from current instructing portion 106 to current control portion 109.

Current control portion 109 cuts driving current i by stopping output of a pulse from inverter 102 in the period when current off is instructed by operation control portion 108. Current control portion 109 controls a pulse output from inverter 102 such that current i detected by position sensor 103 matches the current instruction value $i_s$ in the period when current on is instructed by operation control portion 108.

Figure 32:
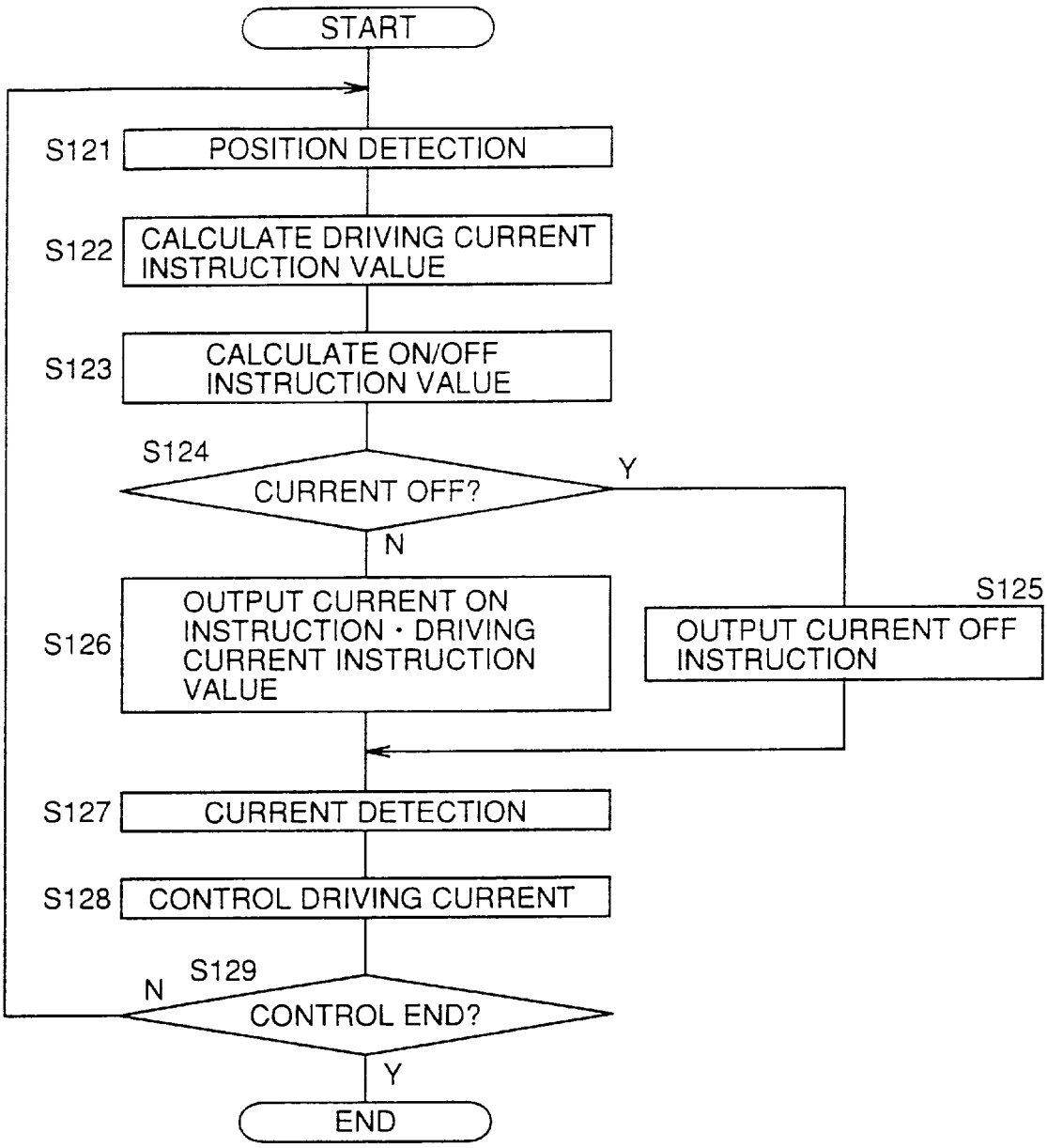
FIG. 32 is a flow chart showing the operation of the control apparatus shown in FIG. 30.

FIG. 32 is a flow chart showing the operation of the control apparatus shown in FIG. 30. The operation of the driving apparatus for linear compressor 80 will be briefly described with reference to FIG. 32.

A DC voltage E is applied from DC power source 101 to inverter 102, and driving current i is applied from inverter 102 to linear compressor 80, whereby linear compressor 80 is driven.

In step S121, each of current instructing portion 106 and on/off instructing portion 107 detects position of piston 82 by position sensor 104. In step S122, current instructing portion 106 calculates current instruction value $i_s$ based on the result of detection by position sensor 104, and in step S123, on/off instructing portion 107 calculates on/off instructing value Φ based on the result of detection by position sensor 104. Current instruction value $i_s$ and on/off instruction value Φ are applied to operation control portion 108.

Operation control portion 108 determines whether current is off based on the on/off instruction value Φ in step S124, and if it is determined that the current is to be off, it instructs current off to current control portion 109 in step 125. If it is determined in step S124 that current i should not be off, operation control portion 108 instructs current on to current control portion 109 in step S126, and applies current instruction value $i_s$ from current instructing portion 106 to current control portion 109.

In step S127, current control portion 109 detects driving current i by current sensor 103, and in step S128, current control portion 109 stops pulse output from inverter 102 in accordance with current off instruction and cuts driving current i, and controls pulse output from inverter 102 such that the value of current i detected by current sensor 108 matches the current instruction value is in accordance with the current on instruction. While current i is cut, supply power is 0, and therefore piston 82 operates bound only by the equation of motion of the mechanical system.

Control apparatus 105 determines whether or not control process is completed in step S129, and if not, control returns to step S121.

Figure 33:
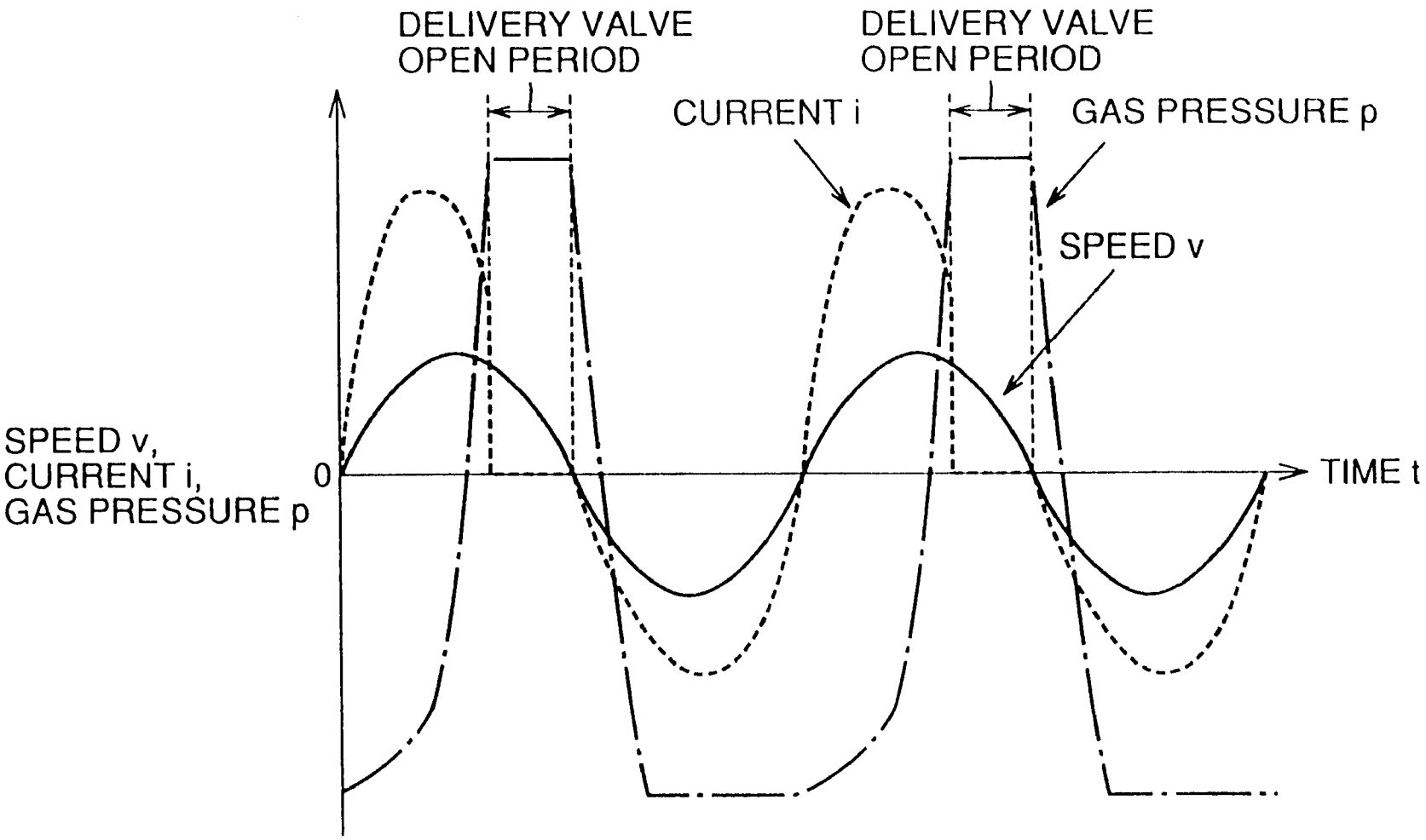
FIG. 33 is a diagram of waveforms showing the effect of the linear compressor driving apparatus shown in FIG. 30.

FIG. 33 is a diagram of waveforms showing speed v of piston 82, driving current i and pressure p in compression space 83, which corresponds to FIG. 29. As driving current i is cut off in the open period of discharge valve 85, ineffective current having different phase from speed V is eliminated, and efficiency higher than the prior art can be obtained.

In this embodiment, driving current i is cut off only in the open period of discharge valve 85. However, current i may be cut in the whole period after speed v of piston 82 reaches the maximum value until the speed v attains 0, that is, after the piston 82 reaches the neutral point until it reaches the upper dead point. Alternatively, current i may be cut off in the period from an arbitrary time point after the speed v attains the maximum value until discharge valve 85 is opened, to the time point at which speed v attains 0. Current i may be set to be cut off after a lapse of time from opening of discharge valve 85 until a little after the discharge valve 85 is closed. The current i should preferably be cut in a period in which efficiency is near maximum and control of current i is easy.

[Tenth Embodiment]

Figure 34:
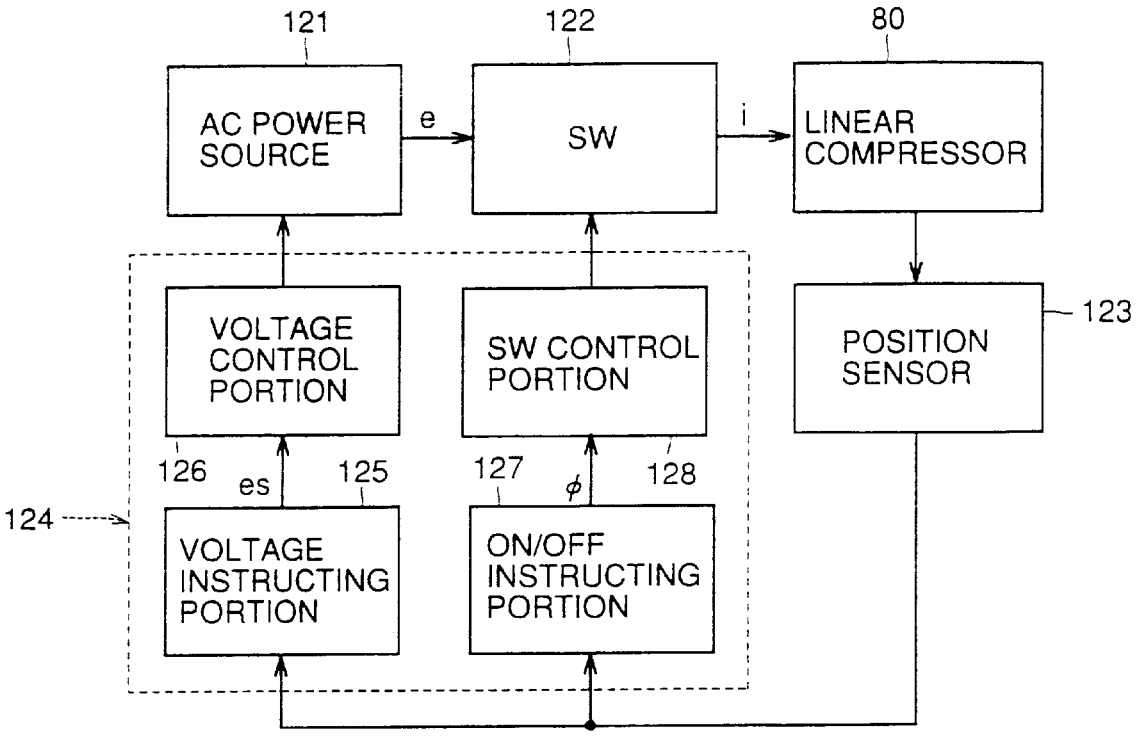
FIG. 34 is a block diagram showing a structure of the linear compressor driving apparatus in accordance with the tenth embodiment of the present invention.

FIG. 34 is a block diagram showing a structure of a driving apparatus for linear compressor 80 in accordance with the tenth embodiment of the present invention. In FIG. 34, the driving apparatus for linear compressor 80 includes an AC power source 121, a switch 122, a position sensor 123 and a control apparatus 124, and control apparatus 124 includes a voltage instructing portion 125, a voltage control portion 126, an on/off instructing portion 127 and a switch control portion 128.

AC power source 121 has its amplitude controlled by voltage control portion 126 of control apparatus 124, and applies the voltage e of the aforementioned resonance frequency to the coil of a liner motor of a compressor 80 through the switch 122.

Switch 122 is controlled by switch control portion 128 of control apparatus 124, and cuts current i flowing from AC power source 121 to linear compressor 80 in the open period of discharge valve 85. Position sensor 123 directly or indirectly detects position of piston 82 of linear compressor 80 and applies the result of detection to voltage instructing portion 125 and on/off instructing portion 127 of control apparatus 124.

Voltage instructing portion 125 of control apparatus 124 calculates current instruction value $e_s$ and applies its to voltage control portion 126, based on the result of detection by position sensor 123. voltage instructing portion 125 detects upper dead point of piston 82 based on the result of detection by position sensor 123, and if the upper dead point of piston 82 is lower than a predetermined position, increases the voltage instructing value $e_s$, and if the upper dead point of piston 82 is higher than the predetermined position, reduces the voltage instructing value $e_s$. Voltage control portion 126 controls amplitude of output voltage e of AC power source 121 in accordance with the voltage instructing value es applied from voltage instructing portion 125.

On/off instructing portion 127 determines open period of discharge valve 85 based on the result of detection by position sensor 123, calculates on/off instruction value Φ based on the result of determination, and applies it to switch control portion 128. On/off instruction value Φ serves as a signal instructing current off in the open period of discharge valve 85, and it serves as a signal instructing current on in other period. Switch control portion 128 renders switch 122 non-conductive in the period when current off is instructed by on/off instruction value Φ applied from on/off instructing portion, and it renders switch 122 conductive in other period.

Figure 35:
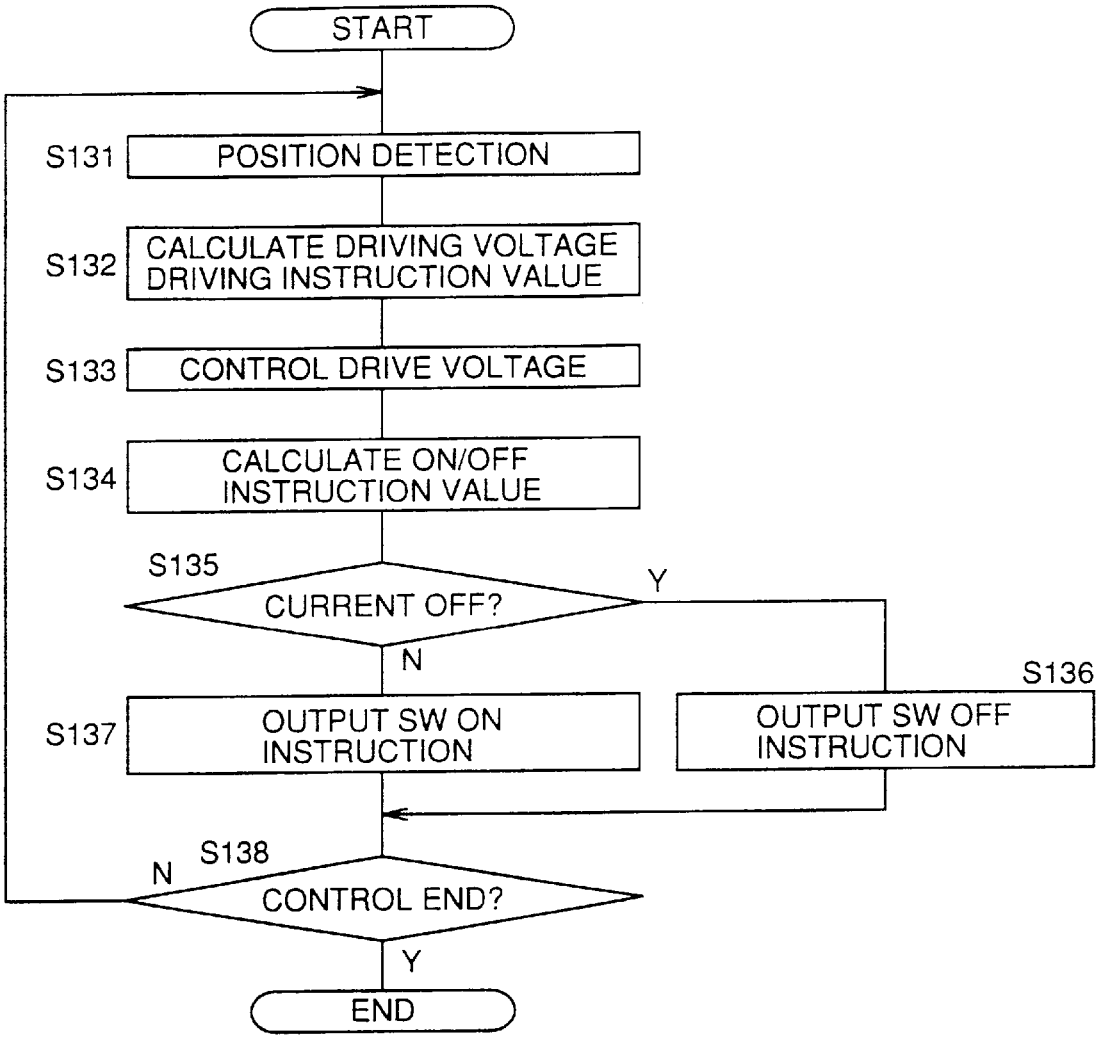
FIG. 35 is a flow chart showing the operation of the control apparatus shown in FIG. 34.

FIG. 35 is a flow chart showing the operation of control apparatus 124 shown in FIG. 34. The operation of the driving apparatus for linear compressor 80 will be briefly described with reference to FIG. 35. The AC voltage e is applied from AC power source 121 to linear compressor 80 through switch 122, and linear compressor 80 is driven.

In step 5131, each of voltage instructing portion 125 and on/off instructing portion 127 detects position of piston 82 by position sensor 123. In step S132, voltage instructing portion 125 calculates voltage instructing values $e_s$ based on the result of detection by position sensor 123, and in step S133, voltage control portion 26 controls output voltage e of AC power source 121 in accordance with the voltage instruction value $e_s$.

In step S134, on/off instructing portion 127 calculates on/off instruction value Φ and applies it to switch control portion 128. Switch control portion 128 determines whether current should be off in step S135, and if it is determined that current is to be off, it instructs switch off in step S136 so that switch 122 is rendered non-conductive. If it is determined that current i is not to be off in step S135, switch control portion 128 instruct switch on in step S137, so that switch 122 is rendered conductive.

Control apparatus 124 determines whether or not control process is completed in step S138, and if not, the flow returns to S131.

In this embodiment also, similar to the ninth embodiment, ineffective current i having different phase from the speed v of piston 82 is eliminated, and efficiency higher than the prior art can be obtained.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A circuit arrangement for driving a reciprocating piston in a cylinder of a linear compressor for generating compressed gas with a linear motor, comprising:

a power source of which output current is controllable, for driving said linear motor;

position instructing means for instructing position of said piston at each time point in said cylinder in accordance with a sine function having as a parameter an angle obtained by multiplying angular velocity by time and having a prescribed amplitude;

position detecting means for detecting position of said piston at each time point in said cylinder;

speed instructing means for instructing speed of said piston at each time point based on a difference between the position at each time point instructed by said position instructing means and the position at each time point detected by said position detecting means;

speed detecting means for detecting speed of said piston at each time point;

current instructing means for instructing the output current at each time point of said power source base on a difference between the speed at each time point instructed by said speed instructing means and the speed at each time point detected by said speed detecting means;

current detecting means for detecting the output current at each time point from said power source;

current control means for controlling the output current at each time point of said power source so that the current at each time point detected by said current detecting means matches the current at each time point instructed by said current instructing means;

phase difference detecting means for detecting phase difference between a function representing time change of the speed of said piston detected by said speed detecting means and a function representing time change of the output current of said power source instructed by said current instructing means; and angular velocity adjusting means for adjusting angular velocity of said sine function used by said position instructing means so that phase difference detected by said phase difference detecting means is eliminated.

2. The circuit arrangement according to claim 1, wherein said speed detecting means detects speed of said piston at each time point based on amount of change per unit time of the position detected by said position detecting means.

3. The circuit arrangement according to claim 1, wherein said speed instructing means calculates a speed instruction value of said piston at each time point by multiplying difference between the position at each time point instructed by said position instructing means and the position at each time point detected by said position detecting means by a first gain constant, and instructs speed of said piston at each time point based on the calculated value;

said current instituting means calculates the output current at each time point of said power source by multiplying difference between the speed at each time point instructed by said speed instructing means and the speed at each time point detected by said speed detecting means by a second gain constant, and instructs the output current at each time point of said power source based on the calculated value;

said driving apparatus for a linear compressor further comprising gain adjusting means for adjusting at least one of said first gain constant used by said speed instructing means and said second gain constant used by said current instructing means, so that phase difference detected by said phase difference detecting means is eliminated.

4. The circuit arrangement according to claim 1, wherein said speed instructing means calculates speed instruction value at each time point of said piston by multiplying difference between the position at each time point instructed by said position instructing means and the position at each time point detected by said position detecting means by a first gain constant, and instructs speed of said piston at each time point based on the calculated value;

said current instructing means calculates the output current at each time point of said power source by multiplying difference between the speed at each time point instructed by said speed instructing means and the speed at each time point detected by said speed detecting means by a second gain constant, and instructs the output current at each time point of said power source based on the calculated value;

said driving apparatus for a linear compressor further comprising:

peak value difference detecting means for detecting difference between a peak value of the position of said piston in said cylinder instructed by said position instructing means and a peak value of the position detected by said position detecting means; and gain adjusting means for adjusting at least one of the first gain constant used by said speed instructing means and the second gain constant used by said current instructing means, so that the peak value difference detected by said peak value difference detecting means is eliminated.

5. The circuit arrangement according to claim 4, wherein said phase difference detecting means detects a zero cross point of a function representing time change of the speed of said piston detected by said speed detecting means and a zero cross point of a function representing time change of the output current of said power source instructed by said current instructing means, and detects said phase difference based on the result of detection.

6. The circuit arrangement according to claim 4, wherein said phase difference detecting means detects a peak point of a function representing time change of the speed of said piston detected by said speed detecting means and a peak point of a function representing time change of the output current of said power source instructed by said current instructing means, and detects said phase difference based on the result of detection.

7. The circuit arrangement according to claim 1, further comprising amplitude adjusting means for adjusting amplitude of said sine function used in said position instructing means in accordance with necessary amount of said compressed gas.

8. The circuit arrangement according to claim 7, wherein said compressed gas is used for cooling an object, and necessary amount of said compressed gas is represented by deviation between temperature of said object and a predetermined target temperature.

9. The circuit arrangement according to claim 1, further comprising:

activating means responsive to instruction of activation of said linear compressor for adjusting at least one of amplitude and angular velocity of said sine function used in said position instructing means such that the amplitude of said piston gradually increases to a predetermined target value; wherein said angular velocity adjusting means is activated in response to completion of activation of said linear compressor.

10. The driving apparatus for a linear compressor according to claim 9, wherein said angular velocity adjusting means is inactivated in response to instruction of stopping of said linear compressor;

said driving apparatus for a linear compressor further comprising stopping means responsive to instruction of stopping of said linear compressor, for adjusting at least one of the amplitude and the angular velocity of said sine function used in said position instructing means such that the amplitude of said piston is gradually reduced.

11. A circuit arrangement for driving a reciprocating piston in a cylinder of a linear compressor for generating compressed gas with a linear motor, comprising:

a power source for outputting a driving current in accordance with a current instruction value to said linear motor;

position instructing means for instructing position at each time point of said piston in said cylinder in accordance with a sine function having as a parameter an angle obtained by multiplying angular velocity by time and having a prescribed amplitude;

position detecting means for detecting position at each time point of said piston in said cylinder;

current instructing means for generating and applying to said power source said current instructing value at each time point such that the position at each time point detected by said position detecting means matches the position at each time point instructed by said position instructing means;

speed detecting means for detecting speed at each time point of said piston in said cylinder;

phase difference detecting means for detecting phase difference between a function representing time change of the current instruction value generated by said current instructing means and a function representing time change of the speed detected by said speed detecting means; and angular velocity control means responsive to the phase difference detected by said phase difference detecting means exceeding a predetermined tolerance, for reducing at least one of the current instruction value generated by said current instructing means and amplitude of said sine function used in said position instructing means to predetermined ratio, and for controlling angular velocity of said sine function to eliminate said phase difference.

12. A circuit arrangement for driving a reciprocating piston in a cylinder of a linear compressor for generating compressed gas with a linear motor, comprising:

a power source for outputting a driving current in accordance with a current instruction value to said linear motor;

current instructing means for generating and applying to said power source a current instruction value at each time point in accordance with a sine function having as a parameter an angle obtained by multiplying angular velocity by time and having a prescribed amplitude;

amplitude detecting means for detecting amplitude of said piston in said cylinder;

speed detecting means for detecting speed of said piston at each time point in said cylinder;

phase difference detecting means for detecting phase difference between a function representing time change of the current instruction value generated by said current instructing means and a function representing time change of the speed detected by said speed detecting means;

amplitude control means for controlling amplitude of said sine function used in said current instructing means such that amplitude detected by said amplitude detecting means matches a predetermined target value; and angular velocity control means responsive to the phase difference detected by said phase difference detecting means exceeding a predetermined tolerance, for reducing the amplitude of said sine function used in said current instructing means to a predetermined ratio, and for controlling angular velocity of said function to eliminate said phase difference.

13. A circuit arrangement for driving a reciprocating piston in a cylinder of a linear compressor for generating compressed gas with a linear motor, comprising:

a power source for outputting a driving current in accordance with a current instruction value to said linear motor;

position instructing means for instructing position of said piston at each time point in said cylinder in accordance with a sine function having as a parameter an angle obtained by multiplying angular velocity by time and having a prescribed amplitude;

position detecting means for detecting position of said piston at each time point in said cylinder;

amplitude detecting means for detecting, based on the result of detection by said position detecting means, an amplitude to an upper dead point side of said piston between the upper dead point and an origin, and an amplitude to a lower dead point side of said piston between the lower dead point and the origin;

current instructing means for generating and applying to said power source a current instruction value at each time point such that the position at each time point detected by said position detecting means matches the position at each time point instructed by said position instructing means, and amplitude control means for controlling at least one of amplitude of said sine function used in said position instructing means and the current instruction value generated by said current instructing means such that larger one of said amplitude to the upper dead point side and the amplitude to the lower dead point side detected by said amplitude detecting means matches a predetermined target value.

14. A circuit arrangement for driving a reciprocating piston in a cylinder of a linear compressor for generating compressed gas with a linear motor, comprising:

a power source for outputting a driving current in accordance with a current instruction value to said linear motor;

current instructing means for generating and applying to said power source a current instruction value at each time point in accordance with a sine function having as a parameter an angle obtained by multiplying angular velocity by time and having a prescribed amplitude;

position detecting means for detecting position at each time point of said piston in said cylinder;

amplitude detecting means for detecting, based on the result of detection by said position detecting means, amplitude to an upper dead point side of said piston between the upper dead point and an origin, and an amplitude to a lower dead point side of said piston between the lower dead point and the origin; and amplitude control means for controlling amplitude of said sine function used in said current instructing means such that larger one of the amplitude to the upper dead point side and the amplitude to the lower dead point side detected by said amplitude detecting means matches a predetermined target value.

15. A circuit arrangement for driving a reciprocating piston in a cylinder of a linear compressor for generating compressed gas with a linear motor, comprising:

a power source for outputting a driving current in accordance with a current instruction value to said linear motor;

position instructing means for instructing position of said piston at each time point in said cylinder in accordance with a sine function having as a parameter an angle obtained by multiplying an angular velocity by time and having a prescribed amplitude and a prescribed shift amount;

position detecting means for detecting position of said piston at each time point in said cylinder;

current instructing means for generating and applying to said power source, a current instruction value at each time point such that position at each time point detected by said position detecting means matches the position at each time point instructed by said position instructing means;

shift amount detecting means for detecting, based on the result of detection by said position detecting means, shift amount of a neutral point of said piston from an origin; and shift amount control means for controlling shift amount of said sine function used in said position instructing means so as to eliminate the shift amount detected by said shift amount detecting means.

16. The circuit arrangement according to claim 15, further comprising:

amplitude detecting means for detecting, based on the result of detection by said position detecting means, an amplitude to a side of upper dead point of said piston between the upper dead point and an origin, and an amplitude to a lower dead point side of said piston between the lower dead point and the origin; and amplitude control means for controlling at least one of amplitude of said sine function used in said position instructing means and the current instruction value generated by said current instructing means such that larger one of the amplitude to the upper dead point side and the amplitude to the lower dead point side detected by said amplitude detecting means matches a predetermined target value.

17. A circuit arrangement for driving a reciprocating piston in a cylinder of a linear compressor for generating compressed gas with a linear motor, comprising:

a power source for outputting a driving current in accordance with a current instruction value to said linear motor;

current instructing means for for generating and applying to said power source a current instructing value at each time point in accordance with a sine function having as a parameter an angle obtained by multiplying an angular velocity by time and having a prescribed amplitude and a prescribed shift amount;

position detecting means for detecting position of said piston at each time point in said cylinder;

amplitude detecting means for detecting amplitude of said piston based on the result of detection by said position detecting means;

shift amount detecting means for detecting shift amount of a neutral point of said piston from an origin based on the result of detection by said position detecting means;

amplitude control means for controlling amplitude of said sine function used in said current instructing means such that the amplitude detected by said amplitude detecting means matches a predetermined target value; and shift amount control means for controlling shift amount of said sine function used in said current instructing means such that the shift amount detected by said shift amount detecting means is eliminated.

18. The circuit arrangement according to claim 17, wherein said amplitude detecting means detects, based on the result of detection by said position detecting means, an amplitude to an upper dead point side of said piston between the upper dead point and an origin, and an amplitude to a lower dead point side between the lower dead point and the origin of said piston, and said amplitude control means control amplitude of said sine function used in said current instructing means such that larger one of the amplitude to the upper dead point side and the amplitude to the lower dead point side detected by said amplitude detecting means matches a predetermined target value.

19. A circuit arrangement for driving a reciprocating piston in a cylinder of a linear compressor for generating compressed gas with a linear motor, comprising:

a power source for driving said linear motor;

detecting means for detecting open period of said discharge valve; and current control means for cutting off current flowing from said power source to said linear motor for a prescribed period including at least a part of an open period of said discharge valve, based on the result of detection by said detecting means.

20. The circuit arrangement according to claim 19, wherein output current of said power source is drivable;

said detecting means includes position detecting means for detecting position of said piston at each time point in said cylinder, and determining means for determining open period of said discharge valve based on the result of detection by said position detecting means;

said driving apparatus for a linear compressor further comprising:

current detecting means for detecting the output current at each time point of said power source; and current instructing means for instructing the output current at each time point of said power source based on the result of detection by said position detecting means; wherein said current control means cuts off the output current of said power source for said prescribed period and controls the output current of said power source such that the current at each time point detected by said current detecting means matches the current at each time point instructed by said current instructing means in a period other than said prescribed period, based on the result of determination by said determining means.

21. The circuit arrangement according to claim 19, wherein the output current of said power source is controllable;

said detecting means includes position detecting means for detecting position of said piston at each time point in said cylinder, and determining means for determining open period of said discharge valve based on the result of detection by said position detecting means;

said driving apparatus for a linear compressor further comprising:

voltage control means for controlling the output voltage of said power source based on the result of detection by said position detecting means; and switch means provided between said power source and said linear motor; wherein said current control means renders said switch means non-conductive for said prescribed period and renders said switch means conductive in a period other than said prescribed period, based on the result of determination by said determining means.

22. The circuit arrangement according to claim 19, wherein said prescribed period matches the open period of said discharge valve.

* * * * *